US008660449B2

(12) United States Patent
Momotani et al.

(10) Patent No.: US 8,660,449 B2
(45) Date of Patent: Feb. 25, 2014

(54) DEVELOPER CONCENTRATION ADJUSTMENT APPARATUS, METHOD FOR ADJUSTING DEVELOPER CONCENTRATION, AND IMAGE FORMING APPARATUS USING THE SAME

(75) Inventors: Keiko Momotani, Ibaraki (JP); Atsuto Hirai, Ikoma (JP); Kazuko Fukumoto, Ibaraki (JP)

(73) Assignee: Konica Minolta Holdings, Inc., Tokyo (JP)

( * ) Notice: Subject to any disclaimer, the term of this patent is extended or adjusted under 35 U.S.C. 154(b) by 518 days.

(21) Appl. No.: 12/943,737

(22) Filed: Nov. 10, 2010

(65) Prior Publication Data

US 2011/0116820 A1 May 19, 2011

(30) Foreign Application Priority Data

Nov. 17, 2009 (JP) ..... 2009-261619
Nov. 30, 2009 (JP) ..... 2009-271211

(51) Int. Cl.
*G03G 15/08* (2006.01)
*G03G 15/10* (2006.01)

(52) U.S. Cl.
USPC ..... 399/58; 399/30; 399/256

(58) Field of Classification Search
USPC ..... 399/30, 57, 58, 256
See application file for complete search history.

(56) References Cited

U.S. PATENT DOCUMENTS 8,121,504 B2 2/2012 Umemoto et al.
2007/0047985 A1* 3/2007 Kamijo et al. ..... 399/45

FOREIGN PATENT DOCUMENTS

JP 2000-221787 8/2000
JP 2008-209716 9/2008
JP 2009-003346 1/2009

OTHER PUBLICATIONS

Office Action mailed Apr. 9, 2013 regarding corresponding Japanese Patent Application No. 2009-271211.
English-language Abstract of JP 2008-209716.

* cited by examiner

*Primary Examiner* — Joseph S Wong
(74) *Attorney, Agent, or Firm* — Brinks Gilson & Lione

(57) ABSTRACT

This invention provides a developer concentration adjustment apparatus, a method for concentration adjustment, and an image forming apparatus, in which concentration adjustment is performed by use of a stirring load as a substitute characteristic of viscosity which represents a developer concentration, wherein a trouble of abnormality generation in toner concentration detection due to drying-adhesion of a residual developer on the stirrer is reduced. At the time of finishing the concentration adjustment, a concentration adjustment tank is made to be empty and the stirrer is cleaned by carrier liquid or a liquid developer having a concentration lower than a predetermined concentration. Alternatively, the stirrer is cleaned by empty-stirring operation not being put in a cleaning developer.

22 Claims, 11 Drawing Sheets

DEVELOPER CONCENTRATION ADJUSTMENT APPARATUS, METHOD FOR ADJUSTING DEVELOPER CONCENTRATION, AND IMAGE FORMING APPARATUS USING THE SAME

This application is based on Japanese Patent Applications No. 2009-261619 filed on Nov. 17, 2009, and No. 2009-271211 filed on Nov. 30, 2009, in Japan Patent Office, the entire content of which is hereby incorporated by reference.

TECHNICAL HELD

The present invention relates to a developer concentration adjustment apparatus to adjust concentration of a liquid developer used for image formation, a method for adjusting developer concentration, and an image forming apparatus using the same.

BACKGROUND

An image forming apparatus using an electrophotographic method is widely used, in which electrographic method an electrostatic latent image is formed on a photoconductor (an image carrier), and the latent image is attached with toner, transferred to a paper sheet, and fixed. In particular, in an image forming apparatus such as an office printer and an on-demand printing apparatus for a large amount of print requiring higher image quality and higher resolution, a wet type development method employing a liquid developer which hardly causes disorder in a toner image used is used.

In recent years, an image forming apparatus using a liquid developer, which is constituted by dispersed toner as a solid content comprising resin and pigment at high concentration in an insulating liquid (a carrier liquid) such as silicone oil, and has high viscosity and high concentration, is proposed.

At the time of development using the liquid developer, development is generally performed by forming a thin developer layer having a thickness of micrometer order on a developer carrier such as a development roller and bringing this developer having been made into a thin layer in contact with a photoconductor. However, a liquid developer remaining on a development roller after development of a latent image on a photoconductor badly affects the succeeding development.

To overcome such a problem, there has been developed a technology to recover the developer remaining on a development roller after development by a cleaning operation. Further, there has been developed a technology to efficiently use developer by reusing the developer having been recovered.

However, developer supplied for development has high concentration and may often considerably change in concentration as a residual developer after consuming a considerable portion of toner for development of a latent image on an image carrier. When this developer is returned as it is into a developer tank, concentration of the developer in a developer tank may change, thereby making it difficult to maintain a predetermined concentration.

To overcome such a problem, there has been proposed a technology to make concentration adjustment of a recovered developer by supplying developer to be adjusted in concentration (such as a high concentration developer or a low concentration developer) before returning the recovered developer into a developer tank.

However, to prepare a developer having a desired concentration by performing concentration adjustment as described above, it is necessary to simply measure the concentration of developer while adjustment.

As a method for simply measuring the concentration of developer, proposed is a technology to calculate developer concentration based on the fact that light transmission of developer depends on concentration.

However, in a high concentration developer generally used in recent years, the above-described method has a problem. That is, since light transmission is low for a thick developer and may be saturated, sensitivity of detection is low, and the change in transmittance to concentration variation is small.

As a method for easily and efficiently measuring concentration of developer having high concentration, there has been also proposed a technology using viscosity. Viscosity relatively largely varies in response to concentration change in a high concentration range. Further, since such a method for measuring viscosity of developer, a characteristic value, such as torque at the time of stirring a developer which can be measured relatively easily can be used as a substitute characteristic (Laid-Open Japanese Patent Application Publication No. 2009-3346).

In Laid-Open Japanese Patent Application Publication No. 2008-209716, proposed is a technology in which an opening is formed in the concentration adjustment tank for excessive developer to overflow through it, whereby a high precision of measurement is secured since the stirring load is measured while stirring a constant amount of developer.

Further, in Laid-Open Japanese Patent Application Publication No. 2009-3346, proposed is a technology in which a load current is measured for the stirrer stirring with no developer stored in the tank and the measured load current is used for correcting the stirring load for developer to be adjusted in concentration, whereby a high precision of measurement is secured.

As described in Laid-Open Japanese Patent Application Publications Nos. 2008-209716 and 2009-3346, in a method for measuring viscosity of developer, it is possible to use a characteristic value such as a rotation torque at the time of stirring the developer, which torque can be measured relatively easily, as a substitute characteristic for viscosity.

However, a liquid developer naturally adheres onto a stirrer used for stirring. In Laid-Open Japanese Patent Application Publications Nos. 2008-209716 and 2009-3346, although there is generated an empty state where a concentration-adjusted liquid developer has been discharged after finishing concentration adjustment, there is no description about handling of the stirrer on which a developer adhered.

Particularly, in the case of using a carrier liquid having high volatility, a high viscosity developer remains on the surface of the stirrer when the stirrer is dried, and such an toner adhesion may occur.

When adhesion of toner is generated on the stirrer for measuring the stirring load, frictional resistance between the stirrer and the liquid developer may vary and affect the measurement of the viscosity of liquid developer, and the concentration may not be correctly adjusted.

In a weekend or a long term vacation, the concentration adjustment tank equipped with the stirrer for concentration adjustment may be left empty without liquid developer for a long period.

This invention has been conceived in view of the above-described problems.

An object of this invention is to provide a developer concentration adjustment apparatus in which a stirring load, which is relatively easily measured, is used as a substitute characteristic for concentration, and abnormality in toner concentration detection due to the adhesion of residual dried developer on the stirrer is reduced, resulting in that concentration is precisely adjusted, and to provide a method for adjusting developer concentration and an image forming apparatus using the same.

SUMMARY

In view of forgoing, one embodiment according to one aspect of the present invention is a developer concentration adjustment apparatus for adjusting a toner concentration of liquid developer containing toner and carrier liquid to a predetermined concentration, the apparatus comprising:

a concentration adjustment tank configured to store first liquid developer which is to be adjusted in concentration, and configured to discharge liquid stored therein, the first liquid developer containing toner and carrier liquid;

a stirrer for stirring the first liquid developer stored in the concentration adjustment tank;

a load detector configured to detect a stirring load of the stirrer while the stirrer is stirring the first liquid developer;

a supplement section configured to supply the concentration adjustment tank with first supplemental developer having a concentration higher than the predetermined concentration, and carrier liquid or second supplemental developer containing second supplemental developer having a concentration lower than the predetermined concentration;

a discharge section configured to discharge the first liquid developer from the concentration adjustment tank; and a controller configured to control the supplement section to supply the first supplemental developer, the second supplemental developer, or the carrier liquid so as to adjust a concentration of the first liquid developer to the predetermined concentration based on the stirring load detected by the load detector, wherein in a cleaning operation for the stirrer, the controller controls the discharge section concentration adjustment tank to discharge the concentration-adjusted first liquid developer from the concentration adjustment so as to empty the concentration adjustment tank, and then controls the supplement section to supply the concentration adjustment tank with the carrier liquid or the second supplemental developer, whereby the stirrer is cleaned with the carrier liquid or the second supplemental developer, and residue of toner in the first liquid developer attached to the stirrer is reduced.

According to another aspect of the present invention, another embodiment is a developer concentration adjustment apparatus for adjusting a toner concentration of liquid developer containing toner and carrier liquid to a predetermined concentration, the apparatus comprising:

a concentration adjustment tank configured to store first liquid developer which is to be adjusted in concentration, and configured to discharge liquid stored therein, the first liquid developer containing toner and carrier liquid;

a stirrer for stirring the first liquid developer stored in the concentration adjustment tank;

a load detector configured to detect a stirring load of the stirrer while the stirrer is stirring the first liquid developer;

a supplement section configured to supply the concentration adjustment tank with supplemental developer for concentration adjustment;

a discharge section configured to discharge the first liquid developer from the concentration adjustment tank; and a controller configured to control the supplement section to supply the supplemental developer so as to adjust a concentration of the first liquid developer to the predetermined concentration based on the stirring load detected by the load detector, wherein the controller controls the stirrer to stir at a stirring speed higher than when detecting the stirring load after the discharge section discharges concentration adjustment tank have discharged the concentration-adjusted first liquid developer from the concentration adjustment tank to be empty the concentration adjustment tank, whereby residue of the first liquid developer attached to the stirrer is removed.

According to another aspect of the present invention, another embodiment is a method for adjusting a toner concentration of liquid developer containing toner and carrier liquid to a predetermined concentration, the method comprising the steps of:

storing first liquid developer which is to be adjusted in concentration, in a concentration adjustment tank, the liquid developer containing toner and carrier liquid;

detecting a stirring load of a stirrer while stirring the first liquid developer stored in the concentration adjustment tank with the stirrer, supplying the concentration adjustment tank with first supplemental developer having a concentration higher than the predetermined concentration, and carrier liquid or second supplemental developer having a concentration lower than the predetermined concentration;

discharging the concentration-adjusted first liquid developer from the concentration adjustment tank;

controlling amount of the first supplemental developer, the second supplemental developer, or the carrier supplied in the step of supplying first supplemental developer and carrier liquid or second supplemental developer, so as to adjust the concentration of the first liquid developer to the predetermined concentration, based on the detected stirring load in the step of detecting stirring load; and supplying the concentration adjustment tank with the carrier liquid or the second supplemental developer after the concentration-adjusted first liquid developer has been discharged from the concentration adjustment to empty the concentration adjustment tank, whereby the stirrer is cleaned with the carrier liquid or the second supplemental developer, and residue of the toner in the first liquid developer attached to the stirrer is removed.

According to another aspect of the present invention, another embodiment is a method for adjusting a toner concentration of liquid developer containing toner and carrier liquid to a predetermined concentration, the method comprising the steps of:

storing liquid developer which is to be adjusted in concentration, in a concentration adjustment tank, the liquid developer containing toner and carrier liquid;

detecting a stirring load of a stirrer while stirring the first liquid developer stored in the concentration adjustment tank with the stirrer at a first stirring speed;

supplying the concentration adjustment tank with supplemental developer for concentration adjustment;

discharging the concentration-adjusted first liquid developer from the concentration adjustment tank;

controlling amount of the supplemental developer supplied in the step of supplying supplemental developer, so as to adjust a concentration of the first liquid developer to the predetermined concentration, based on the detected stirring load in the step of detecting a stirring load; and causing the stirrer to stir at a second stirring speed equal to or higher than the first stirring speed after the concentration adjustment tank has been emptied by discharging the concentration -adjusted first liquid developer from the concentration adjustment tank in the step of discharging the first liquid developer, whereby residue of the first liquid developer attached to the stirrer is removed.

According to another aspect of the present invention, another embodiment is an image forming apparatus, comprising:

an image carrier configured to carry an electrostatic latent image formed on a surface thereof;

a liquid developing apparatus configured to develop the electrostatic latent image on the surface of the image carrier to form a toner image; and the developer concentration adjustment apparatus of claim 1, wherein the developer concentration adjustment apparatus is configured to supply the first liquid developer whose concentration has been adjusted to the predetermined concentration to the liquid developing apparatus.

According to another aspect of the present invention, another embodiment is a developer concentration adjustment apparatus for adjusting a toner concentration of liquid developer containing toner and carrier liquid to a predetermined concentration, the apparatus comprising:

a concentration adjustment tank configured to store first liquid developer which is to be adjusted in concentration, and configured to discharge liquid stored therein, the first liquid developer containing toner and carrier liquid;

a stirrer for stirring the first liquid developer stored in the concentration adjustment tank;

a load detector configured to detect a stirring load of the stirrer while the stirrer is stirring the first liquid developer under a first stirring condition;

a first supplement section configured to supply the concentration adjustment tank with first supplemental developer for concentration adjustment; and a discharge section configured to discharge the first liquid developer from the concentration adjustment tank;

a controller configured to control the first supplement section to supply the first supplemental developer so as to adjust a concentration of the first liquid developer to the predetermined concentration, based on the stirring load detected by the load detector, wherein in a cleaning operation for the stirrer, the controller controls in such a manner that before the first liquid developer is stored in the empty concentration adjustment tank for the concentration adjustment, the stirrer is cleaned while being immersed in second liquid developer for cleaning and stirring under a second stirring condition different from the first stirring condition.

According to another aspect of the present invention, another embodiment is a method for adjusting a toner concentration of liquid developer containing toner and carrier liquid to a predetermined concentration, the method comprising the steps of:

storing first liquid developer which is to be adjusted in concentration, in a concentration adjustment tank, the liquid developer containing toner and carrier liquid;

detecting a stirring load of a stirrer while stirring the first liquid developer stored in the concentration adjustment tank with the stirrer under a first stirring condition;

supplying the concentration adjustment tank with a first supplemental developer for concentration adjustment;

discharging the concentration-adjusted first liquid developer from the concentration adjustment tank;

controlling amount of the first supplemental developer to be supplied in the step of supplying a first supplemental developer so as to adjust a concentration of the first liquid developer to the predetermined concentration, based on the detected stirring load in the step of detecting a stirring load; and causing the stirrer to stir under a second stirring condition different from the first stirring condition after the concentration adjustment tank has been emptied with the concentration -adjusted first liquid developer having been discharged in the step of discharging the concentration-adjusted first liquid developer, whereby toner attached to the stirrer is removed.

According to another aspect of the present invention, another embodiment is an image forming apparatus, comprising:

an image carrier configured to carry an electrostatic latent image formed on a surface thereof;

a liquid developing apparatus configured to develop the electrostatic latent image on the surface of the image carrier to form a toner image; and the developer concentration adjustment apparatus of claim 13, wherein the developer concentration adjustment apparatus is configured to supply the first liquid developer whose concentration has been adjusted to the predetermined concentration to the liquid developing apparatus.

DETAILED DESCRIPTION OF THE PREFERRED EMBODIMENT

An embodiment according to this invention will be explained in reference to the drawings.

A liquid development apparatus using liquid developer is used for an image forming apparatus such as a copier, a simple printing machine, and a printer. In these image forming apparatuses, an electrophotographic image forming process is commonly used. First, a wet type image forming apparatus using an electrophotographic process will be explained in reference to FIG. 1, and further, with respect to a liquid development apparatus (refer to FIG. 2) which reuses a recovered developer and a developer concentration adjustment apparatus used therein, the constitution and functional operation will be explained (refer to FIG. 3).

(Constitution and Functional Operation of Image Forming Apparatus)

Figure 1:
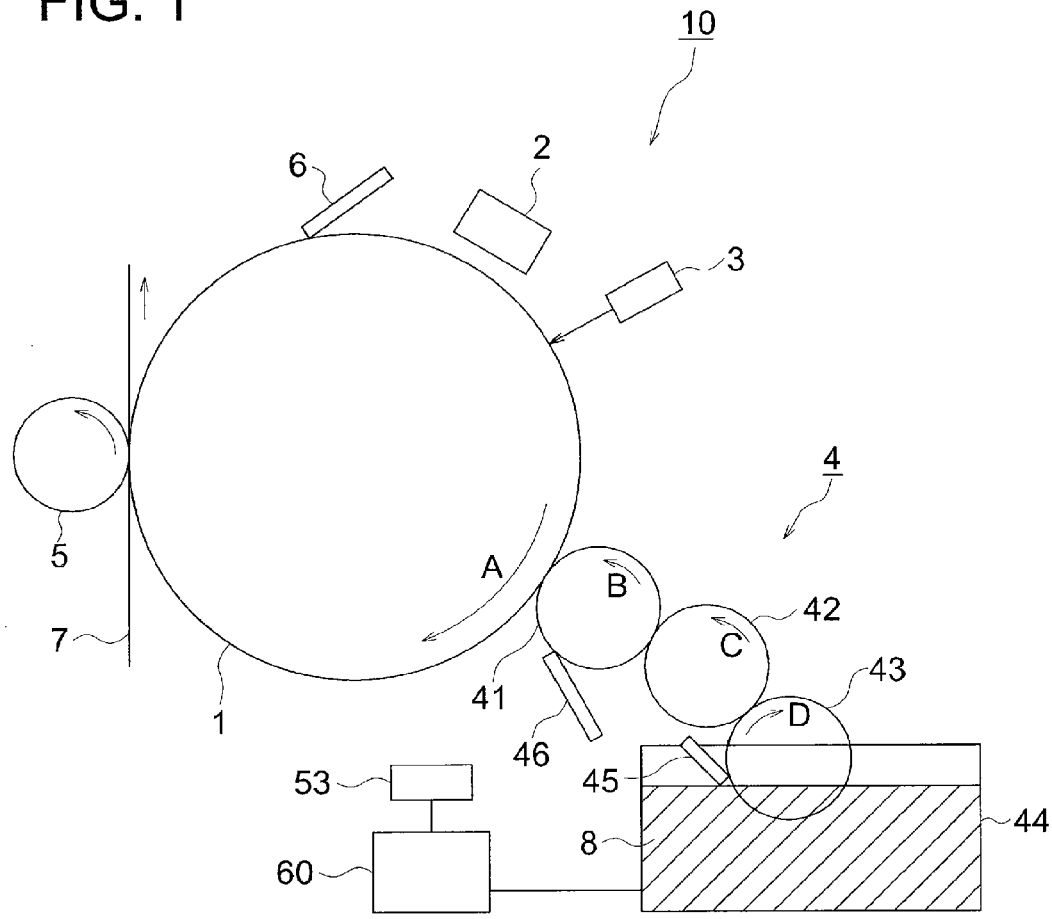
FIG. 1 is a cross-sectional view to show an example of a schematic constitution of image forming apparatus 10 of an embodiment according to this invention.

A constitutional example of an image forming apparatus of this embodiment will be explained in reference to FIG. 1. FIG. 1 is a cross-sectional view to show a schematic constitutional example of a wet type image forming apparatus.

In FIG. 1, reference numeral 1 is a photoconductor drum which functions as an image carrier. Image forming apparatus 10 is equipped, around the photoconductor drum 1 as a center, with charging device 2 to uniformly charge the surface of the photoconductor drum 1; an exposure device 3 to from an electrostatic latent image on the charged photoconductor drum 1 by irradiation of an LED or a laser beam; a liquid development apparatus 4 to develop the electrostatic latent image by use of liquid developer; a transfer device 5 to transfer the developed toner image onto a transfer material 7; and a cleaning device 6 to remove the liquid developer remaining on the photoconductor drum after transfer.

Further, an apparatus to coat in advance or recover a part of liquid developer may be provided before and after liquid development apparatus 4. Transfer material 7 may be a recording material itself such as a recording paper, or an intermediate transfer belt may be used as the transfer material 7, where the image is transferred again to a recording material.

The liquid development apparatus 4 is equipped with a development roller 41 which generally carries a thin layer of liquid developer on the surface thereof and develops an electrostatic latent image on the photoconductor drum 1 as the image carrier; a transfer miler 42 which is in contact with the development roller 41 and transfers liquid developer whose amount has been adjusted onto the surface thereof; and a supply roller 43 which is in contact with the transfer roller 42 and supplies liquid developer 8 in a developer tank 44 onto the surface thereof.

In FIG. 1, only one set of liquid development apparatus 4 is arranged; however, plural sets may be arranged for color image formation. A method of color development and presence or absence of intermediate transfer may be determined as desired, and any constitution and arrangement may be accordingly employed.

Figure 8:
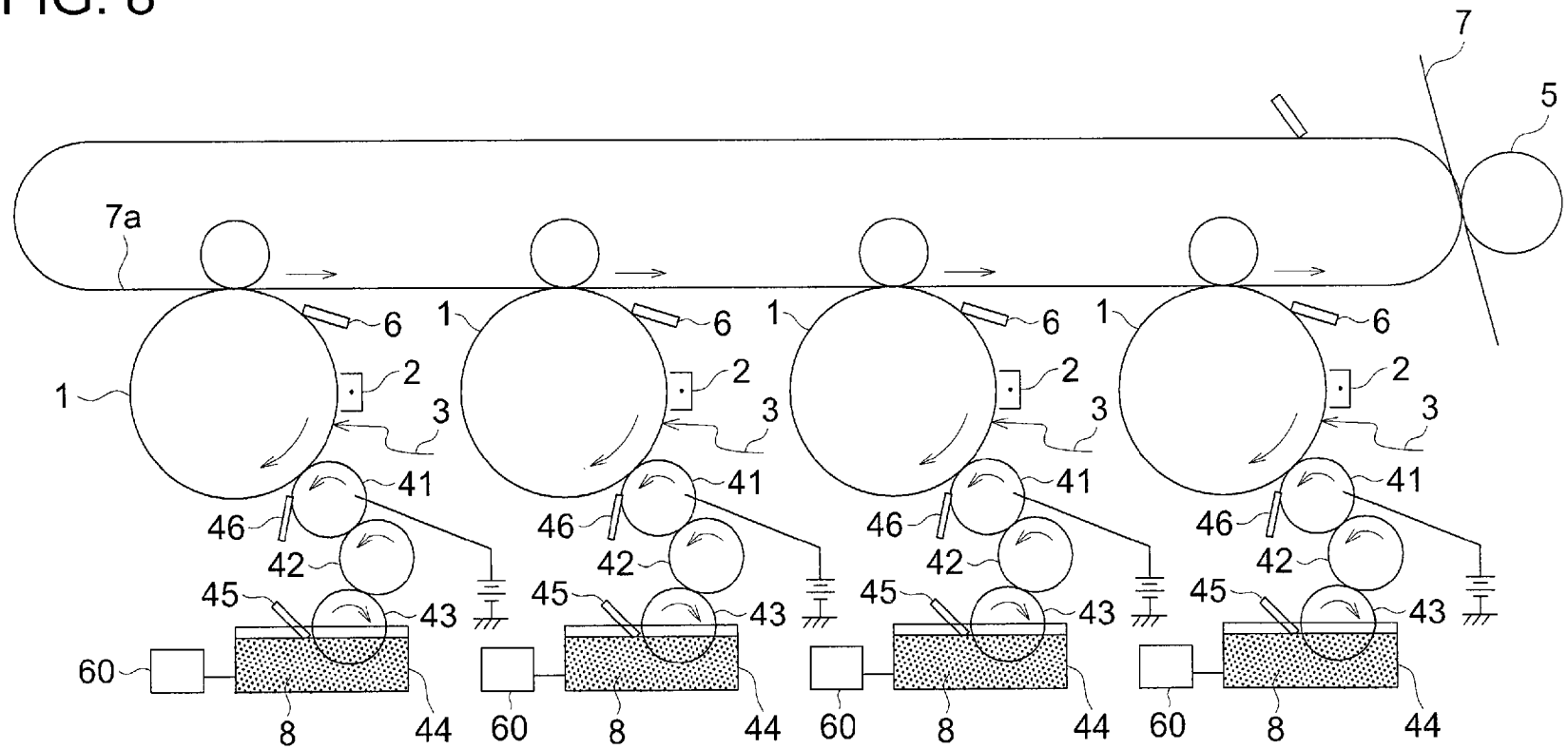
FIG. 8 is a cross-sectional view to show an example of a schematic constitution of an image forming apparatus 10 of another embodiment according to this invention.

Another brief constitutional example of the image forming apparatus will be also shown in FIG. 8. The same symbols are assigned to constitutional elements having the same functions as those in FIG. 1, and the explanation thereof will be omitted.

Image forming processes are similar to those described in reference to FIG. 1; however, image forming sections including liquid development apparatuses 4 of four sets, each of which is for each of CMYK, are arranged for color image formation. In this constitution, respective color toner images are once stacked on the recording material 7, and are then transferred to an intermediate transfer member 7*a*. at a time Returning to FIG. 1, the explanation of the image formation operation will be continued.

The photoconductor drum 1 rotates in an arrow head direction shown in FIG. 1 and the charging device 2 charges the surface of the rotating photoconductor drum 1 to approximately a few hundreds volts by corona discharge. On the downstream side of the charging device 2 in the rotating direction of the photoconductor drum, an electrostatic latent image whose surface potential is equal to or lower than approximately a hundred volts is formed by a laser beam irradiated from the exposure device 3.

T liquid development apparatus 4 is arranged on the further downstream side of the exposure device 3, and the electrostatic latent image formed on the photoconductor drum 1 is developed by use of the liquid developer 8.

In the liquid development apparatus 4, the liquid developer 8 containing toner dispersed in insulating solvent (hereinafter, also referred to as carrier liquid) is stored in the developer tank 44 and the liquid developer 8 is supplied onto the surface of the transfer roller 42 by use of the supply roller 43.

The transfer roller 42 transfers a thin layer of the liquid developer 8 onto the development roller 41. And a thin layer of the liquid developer 8 is carried on the development roller 41. Further, toner particles in the thin layer of the liquid developer 8 carried on the development roller 41 are transferred to the electrostatic latent image on the photoconductor drum 1 by a potential difference between the development roller 41 and the electrostatic latent image, whereby an electrostatic latent image is developed.

In the transfer device 5, the transfer material 7, which is conveyed at the same speed as the circumferential speed of the photoconductor drum 1, is charged or supplied with a voltage, whereby the toner image developed on the photoconductor drum 1 is transferred onto the transfer material 7.

In the downstream side of the transferring apparatus 5, the cleaning device 6 to remove the liquid developer 8 remaining on the surface of the photoconductor drum 1 is arranged. The liquid developer 8 remaining on the photoconductor drum 1 is removed by the cleaning device 6.

In the case that the transfer material 7 is a recording material, on which a toner image has been transferred by the transfer device 5, is conveyed to a fixing apparatus which is not shown in the drawing and is fed out after having been heat-fixed. In the case of transfer material 7 is an intermediate transfer material such as an intermediate transfer belt, the toner image is again transferred onto the recording material, and the recording material on which the toner image has been transferred is also conveyed to the fixing apparatus and is then fed out after heat-fixation.

(Constitution of Developer)

The liquid developer 8 used for development will now be explained. The liquid developer 8 is contains colored toner particles dispersed in carrier liquid as a solvent at a high concentration. Further, additives such as a dispersant and a charge controlling agent may be appropriately selected and added.

As the carrier liquid, an insulating solvent being volatile at ordinary temperature is used. The toner particles are primarily contains resin and pigment or dye for coloring. The resin has a function to uniformly disperse pigment and dye in the resin and a function as a binder at the time of being fixed on the recording material.

The volume average particle size of the toner is preferably in a range of not less than 0.1 μm and not more than 5 μm. The developability is very low when the mean particle size of toner is less than 0.1 μm. On the other hand, quality of image is not good when the mean particle size is more than 5 μm.

The mass ratio of the toner particles to the liquid developer is suitably around from 10 to 40%. Precipitation of the toner particles is easily caused when it is less than 10%, resulting in a problem of poor long term storage stability. Further, since it is necessary to supply a large amount of developer to obtain a required image density, the carrier liquid adhered on the paper will increase, whereby it needs to be dried when fixing, which causes an environmental problem due to generation of vapor. In the case of over 40%, the viscosity of the liquid developer is excessively high, thereby making manufacturing and handling difficult.

(Constitution and Operation of Development Apparatus)

Figure 2:
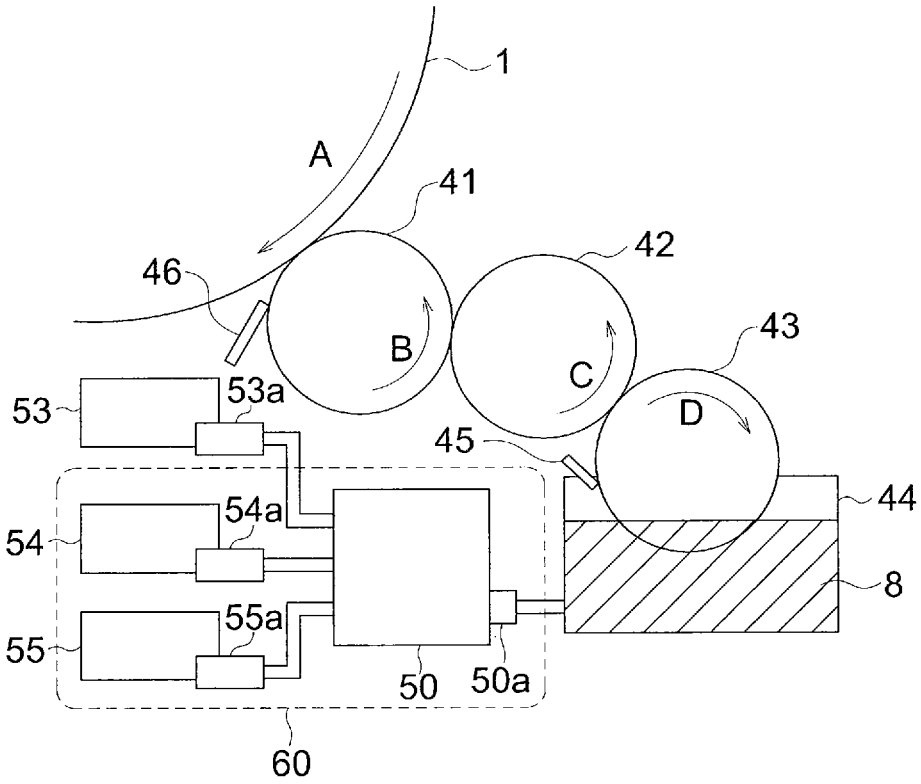
FIG. 2 is a diagram to show an arrangement of an example of an schematic constitution of liquid development apparatus 4 in FIG. 1.

In FIG. 2, a schematic constitutional example of the liquid development apparatus 4 in FIG. 1 is shown. The constitution and operation of the liquid development apparatus 4 will be explained in reference to FIG. 2.

The above-described liquid developer 8 is stored in developer tank 44.

The supply roller 43 is arranged to be in the liquid developer 8 in the developer tank 44 and rotates in the arrow head D direction to pump up the liquid developer 8 from the developer tank 44. The liquid developer 8 having high viscosity is transferred being adhered to the surface of the supply roller 43 owing to the viscosity.

A regulation member 45 is arranged opposing to and in contact to the supply roller 43 in the counter direction with respect to the rotation as shown in the drawing, and regulates the amount of the developer transferred being adhered to the surface of the supply roller 43. In this arrangement, the excessive developer amount is peeled off and forms a developer thin layer on the surface of supply roller 43, and the developer is conveyed toward the next transfer roller 42.

As the transfer roller 42, generally used is a rubber roller. The transfer roller 42 is arranged opposing to the supply roller 43 and rotates in the arrow head C direction while being in contact with the supply roller 43. At the nip potion therebetween, the developer thin layer formed on the surface of the supply roller 43 is transferred to the surface of the transfer roller 42 and is conveyed toward the development roller 41.

As the development roller 41, a roller made of a low hardness rubber is used. The development roller 41 is arranged opposing to the transfer roller 42 and rotates in the arrow head B direction while being in contact with the transfer roller 42. At the nip potion therebetween, the developer thin layer conveyed on the surface of the transfer roller 42 is peeled off by the development roller 41 and is supported and conveyed on the surface of the development roller 41. Therefore, the development roller 41 functions as a developer carrier.

In this embodiment, the transfer roller 42 forms a developer thin layer to be transferred to a developer carrier, however, the supply roller 43 may has additionally that function. In that arrangement, developer is transferred from the supply roller 43 directly to the development roller 41.

The development roller 41 is rotating in contact with also the photoconductor drum 1 which is an image carrier, and the developer thin layer having been transferred to a nip potion between the development roller 41 and the photoconductor drum 1, which is a development region, develops the electrostatic latent image on the photoconductor drum 1.

However, the thin layer of the developer remains on the surface of the development roller 41 after the electrostatic latent image on the photoconductor drum 1 is developed. When the residual developer is conveyed to a development region again, there is caused a bad effect on the successive development. A removing member 46 is a blade for cleaning and removes the residual developer.

(Constitution for Recovery and Reuse of Developer)

FIG. 2 also shows a schematic constitution for recovering and reusing the residual developer having been removed in the liquid development apparatus 4 of FIG. 1. A constitution related to recovery and reuse of the liquid developer in the liquid development apparatus 4 will be explained in reference to FIG. 2.

As described above, the developer thin layer remaining on the development roller 41 is removed by the removing member 46. However, since the developer having been recovered there is accumulated, it is necessary to prepare a storing container when the accumulated developer is discarded. Thus, this embodiment adopts a constitution which does not require such a container and enables an efficient reuse of the recovered developer.

A developer peeled off from the surface of the development roller 41 by the removing member 46 is once stored in a recovered developer tank 53 as a recovered developer.

The developer having been once stored in the recovered developer tank 53 is sent by a recovered developer supply section 53*a* to a concentration adjustment tank 51 of the developer concentration adjustment apparatus 60 to be adjusted to a predetermined concentration for reuse.

The recovered developer having been adjusted to a predetermined concentration in the developer concentration adjustment apparatus 60 is supplied to the developer tank 44 of the liquid development apparatus 4 to be reused. Otherwise, the recovered developer may be supplied to the developer tank 44 after once stored in a supply tank (not shown in the drawing).

<Constitution of Developer Concentration Adjustment Apparatus>

Figure 3:
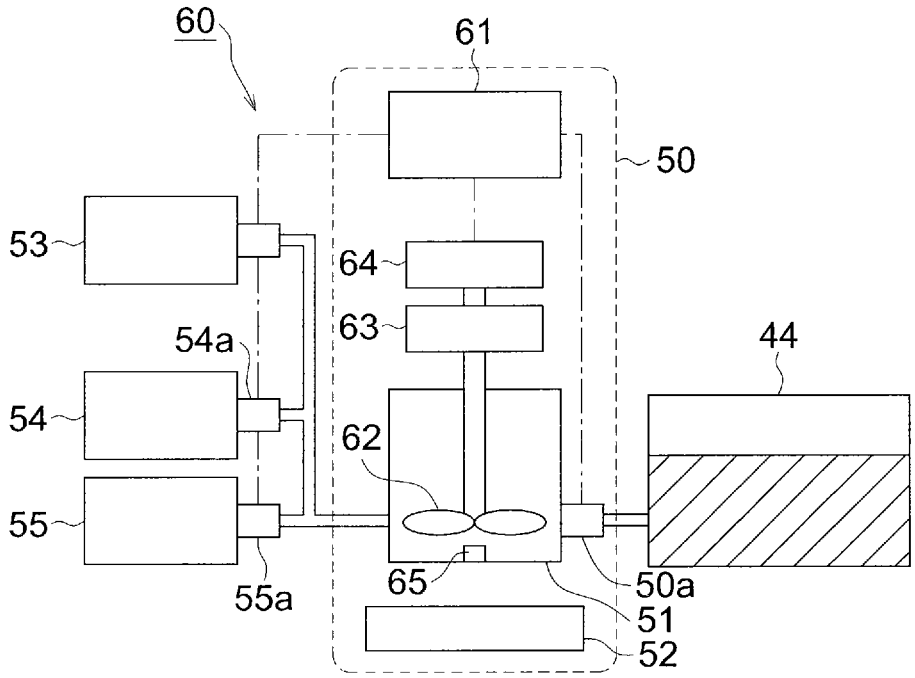
FIG. 3 is a diagram to show an arrangement of an example of a schematic constitution of a developer concentration adjustment apparatus 60 in FIG. 2.

As for the developer concentration adjustment apparatus 60 shown in FIG. 2, a schematic constitutional example thereof is shown in FIG. 3. A constitution related to the concentration adjustment of the recovered developer in the developer concentration adjustment apparatus 60 will be described in reference to FIGS. 2 and 3.

The developer concentration adjustment apparatus 60 includes a developer concentration measuring section 50; a first supplemental developer tank 54 and a first supplemental developer supplying section Ma which function as a first supplemental developer supplement section; and a second supplemental developer tank 55 and a second supplemental developer supplying section 55*a* which function as a second supplemental developer supplement section. The first and second supplemental developer supplement sections function as a supplement section.

In the first supplemental developer tank 54, for example, liquid developer having a concentration higher than a predetermined concentration is stored as the first supplemental developer, which is supplied to the developer concentration measuring section 50 by the first supplemental developer supplying section 54*a*.

In the second supplemental developer tank 55, for example, liquid developer (including the case of having only carrier liquid) having a concentration lower than the predetermined concentration is stored as the second supplemental developer, which is supplied to the developer concentration measuring section 50 by the second supplemental developer supplying section 55*a*.

In the developer concentration adjustment apparatus 60, the recovered developer having been sent for concentration adjustment is sent to the developer concentration measuring section 50 as developer to be adjusted in concentration.

In the developer concentration measuring section 50, concentration (actually a stirring load such as a motor current value corresponding to viscosity) of the developer to be adjusted in concentration is measured. The first supplemental developer or the second supplemental developer, which is described above, is supplied depending on the comparison result with the predetermined concentration (for example, a predetermined current value, that is, a target current value). That is, supplied is a developer having a higher concentration (the first supplemental developer) in the case of a lower concentration than the predetermined concentration, or supplied is a developer having a lower concentration (the second supplemental developer) in the case of a higher concentration than a predetermined concentration.

In the developer concentration adjustment apparatus 60, concentration measurement performed by the above-described developer concentration measuring section 50 and the supply of the supplemental developer are continued until the developer to be adjusted in concentration gets to have the predetermined concentration.

When the developer to be adjusted in concentration gets to have the predetermined concentration, the concentration adjustment finishes and the developer to be adjusted in concentration having been concentration-adjusted is supplied from the developer concentration adjustment apparatus 60 to the developer tank 44 of the liquid development apparatus 4. A detailed processing procedure of the concentration adjustment in the developer concentration adjustment apparatus 60 will be described later.

<Constitution of Developer Concentration Measuring Section>

As for the developer concentration measuring section 50 shown in FIG. 2, the schematic constitutional example is shown also in FIG. 3. A constitution related to the concentration measurement of the recovered developer in the developer concentration measuring section 50 will be explained in reference to FIGS. 2 and 3.

The developer concentration measuring section 50 includes a concentration adjustment tank 51; a discharged-developer tank 52; a controller 61; a stirrer 62; a drive section 63 and a load detector 64.

The concentration adjustment tank 51 stores the developer to be adjusted in concentration and adjusts the concentration. The developer to be adjusted in concentration in the concentration adjustment tank 51 is stirred by driving the stirrer 62 with the drive section 63, and the concentration is measured by detecting a load by load detector 64. The constitution of the arrangement is shown in FIG. 4.

Figure 4:
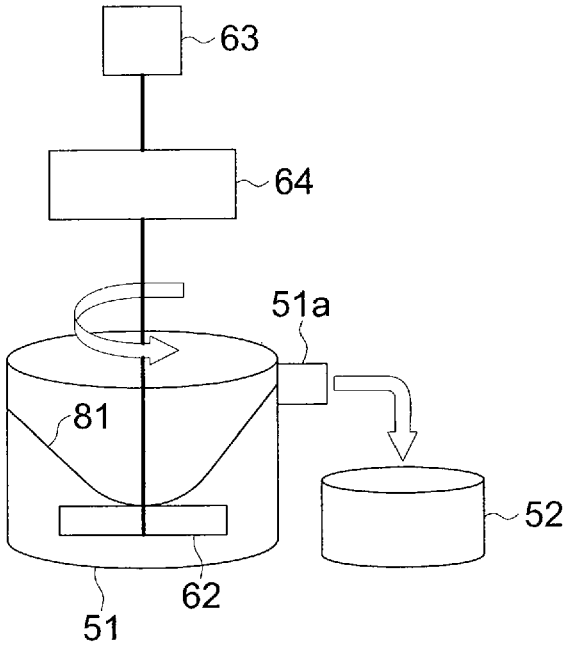
FIG. 4 is a diagram to show an apparatus constitution for explaining an operation of a developer concentration measuring section 50 in FIG. 3.

The explanation will be continued in reference to also FIG. 4 together.

In this embodiment, the concentration adjustment tank 51 is a cylindrical tank and provided with an opening 51*a*. The opening 51*a* has a function to maintain the amount of the developer to be adjusted in concentration constant by letting the excessive developer to overflow through the opening 51*a* when the solution amount of the stored developer to be adjusted in concentration increases so that the liquid surface exceeds the height of the opening.

The discharged-developer tank 52 is a tank to receive and store the developer overflowing in the above manner. The stored developer may be discarded; however, it is preferable that the developer is efficiently used again as the developer to be adjusted in concentration at the next concentration adjustment. Further, the developer may be directly returned to the recovered developer tank 53 without arranging discharged-developer tank 52.

The stirrer 62, which is for example a stirring blade, is arranged in the concentration adjustment tank 51, and stirs the stored developer to be adjusted in concentration by rotational drive caused by a drive section 63. The drive section 63, which is for example a motor, rotates a stirring blade as the stirrer 62 under a predetermined condition. That is, the stirrer 62 and the drive section 63 function as a stirring section.

A load detector 64 is an device to detect a load for driving the stirrer 62 by the drive section 63, and obtains a detected value corresponding to the viscosity of liquid developer. The viscosity depends on concentration. That is, the load detector 64 functions as a load detection section.

As the load detector 64, an ammeter is used to measure a current value required for motor rotation under a predetermined condition as a load for the rotation of the rotation blade with a motor. The torque at rotation may be measured with a dynamic torque meter. The stirrer 62 is not limited to a rotating stirring fan. The drive section 63 and the load detector 64 may be set depending on the form of the stirrer 62.

The controller 61 controls these constituent elements to obtain such as a concentration or a current value corresponding to the concentration of a developer to be adjusted in concentration. Further, based on comparison with a predetermined concentration (or a target current value corresponding the concentration), the controller 61 controls supply operation of the first supplemental developer supplement section or the second supplemental developer supplement section for concentration adjustment. That is, controllers 61 functions as a control section.

The controller 61 as a control section also controls the whole process of a liquid developer from the storing process of the developer to be concentration-adjusted in the concentration adjustment tank 51 to the discharging process of the concentration-adjusted developer into the developer tank 44.

(Concentration Measurement Mechanism in Developer Concentration Measurement Section)

The above-described constitution of the developer concentration measurement section 50 is a constitution for calculation of concentration based on the detected motor current as the load at the time of stirring the developer to be concentration-adjusted in with a stirring section. It is based on the fact that viscosity depends on the concentration of developer to be adjusted in concentration and that a load of stirring depends on the viscosity of developer.

In the following, a conventional method for developer concentration measurement which is different from this embodiment will be described.

A liquid developer contains toner dispersed in carrier liquid as described above. The concentration of liquid developer is expressed by the concentration of toner in the developer. As a method to measure this concentration, light transmittance is conventionally often measured.

However, in recent years, liquid developer having a high concentration is generally used as described above. With respect to developer having a high concentration, light transmittance is saturated at a low value so that its sensitivity is not sufficient.

Instead of measuring transmittance, it has been intended to determine the concentration by measuring viscosity. Viscosity also depends on the concentration of developer. In particular, a viscosity variation is large even in a high concentration range so that measurement can be done with a sufficient sensitivity.

Further, the load of stirring developer depends on the viscosity of developer. It is possible to measure viscosity and hence concentration based on a stirring load. This embodiment also adopts this method.

It is simple to measure a current value as a stirring load of a motor used for driving a stirring blade. A current value required for rotation at a predetermined rotation may be measured with an ammeter. Of course, any other method such as measuring a dynamic torque with a dynamic torque meter is possible.

<Liquid Amount Control of Developer to be Adjusted in Concentration>

However, to determine viscosity from a stirring load, the condition at the time of stirring should be constant. It is necessary to control a condition of the apparatus as well as a rotation condition and further a liquid amount of the developer to be stirred when the stirring blade is rotated.

In this embodiment, adopted is a constitution that concentration adjustment tank 51 is provided with opening 51 for letting the developer to be measured overflow so as to make the liquid amount constant. In practice, the liquid surface will be in a bowl shape when being stirred, the liquid amount in a state while being overflowing or after having been overflowed will differs depending on viscosity.

As it is clear in FIG. 4, the liquid of the developer shifts toward the outside direction due to the centrifugal force of rotation of the stirring blade, and the liquid surface 81 is in a deep bowl shape.

Therefore, when an opening 51*a* is provided, a liquid amount will varies depending on developer viscosity because the upper limit of the liquid surface height is regulated at the outermost portion.

In this embodiment (refer to FIG. 4), an idea to always control a liquid amount regardless of viscosity when stirring to be constant is not adopted. Instead, provided is a constitution in which the liquid amount when stirring is constant when a developer has the same viscosity. In this embodiment (refer to FIG. 4), when the developer has the same viscosity, the same bowl form of the liquid surface is realized to achieve the same liquid amount by controlling the liquid surface with the opening 51*a*.

Of course, the liquid amount depends on the viscosity of developer; however, since a predetermined liquid surface, that is a predetermined liquid amount, is achieved depending on each viscosity, the liquid amount corresponds to the stirring load depending on viscosity.

It is not necessary to perform liquid amount control each time for viscosity measurement, and necessary control is automatically performed by the opening 51*a*. Even when a developer having a different concentration is supplied during measurement, a liquid amount is automatically controlled depending on viscosity change.

<Measurement of Current Value as Stirring Load>

As a stirring load, a current value of the motor 63 which is used to drive the stirring blade 62 is measured, as described above. The stirring blade is rotated at a predetermined rotation speed and the current value at this time is measured by the ammeter 64.

A motor current value as a stirring load corresponding to a developer having the predetermined concentration is obtained in advance and is made to be a target current value. A current value measured when stirring the developer to be adjusted in concentration is compared with the target current value held, and the controller 61 controls so that the first supplemental developer or the second supplemental developer is supplied depending on the magnitude relation thereof.

Alternatively, the target current value is a target range having an allowance, where the control may be finished in the case of the measured current value being within the range, or the first supplemental developer or the second supplemental developer is supplied depending on whether the measured current value is above or below than the target range.

(Reduction of Dried Developer Adhered to f Stirrer)

As described above, the developer concentration adjustment apparatus according to this embodiment has a constitution to calculate viscosity, that is, concentration of a developer by detecting a stirring load when stirring the developer to be adjusted in concentration by use of the stirrer.

Therefore, a stirring load is required to accurately correspond to viscosity, and for this reason, it is desirable to adopt a constitution to set a constant amount of a developer to be measured, as described above. Further, it is preferable to control other environmental conditions (such as temperature of a liquid developer).

However, in the case of a constitution to make a stirring load by use of a stirrer correspond to viscosity being adopted, it is necessary to take the following points in consideration. That is, the liquid developer will naturally adhere on the stirrer 62.

After finishing concentration adjustment, the concentration-adjusted liquid developer is discharged by the discharge section 50*a* to the developer tank 44 from the concentration adjustment tank 51 to be supplied for development. Thus, there may be a case that the concentration adjustment tank 51 provided with the stirrer 62 for concentration adjustment is possibly left empty without a liquid developer for a long time incase of a weekend and a long term vacation.

In particular, in the case of using a carrier liquid having high volatility, a high viscosity developer may remain on the surface of the stirrer, possibly resulting in adhesion of toner when the surface of the stirrer 62 is dried in an empty state where the liquid developer having been discharged.

When the toner is adhered to the stirrer for measuring the stirring load, friction resistance between the stirrer and the liquid developer will be changed and influence the viscosity measurement of the liquid developer, resulting in possible generation of a trouble to adversely affect correct concentration adjustment.

To reduce such adhesion of toner on a stirrer caused by drying, the following control is performed in this embodiment.

<Mechanism for Cleaning Adhered Developer to Stirrer>

The point of the cleaning is to supply a cleaning developer the stirrer into the concentration adjustment tank 51 after the concentration adjustment performed by the control of the controller 61, so as to put the stirrer 62 in the supplied cleaning developer in the concentration adjustment tank 51, and to perform stirring operation to clean the stirrer 62.

That is to say, the high viscosity developer or the toner remaining adhered on the surface of the stirrer 62 is washed off by the stirring operation being put in the cleaning developer or being rinsed with a supplied cleaning developer. Alternatively, the adhered developer is shaken off by centrifugal force and removed by stirring operation without being put in the developer.

Regarding the stirrer 62, at least the surface of which is preferably formed of a water -repellant material. This is to make a high viscosity liquid developer hardly adhere and easily removable, and the surface may be provided with a water-repellant coating or a stirrer made of a water-repellant material may be adopted.

Water-repellant materials include fluorine materials such as Teflon (a registered trademark) and PTFE. Other than fluorine materials, listed are silicone materials, polypropylene and polyethylene.

The water-repellant coat may be provided on the resin or metallic surface of such as aluminum and SUS. Coating materials include fluorine materials such as Teflon (a registered trademark), PFA and PTFE. Other than fluorine materials, listed are silicone materials, polypropylene and polyethylene.

In the case of using the cleaning developer, carrier liquid or liquid developer having a concentration lower than that of the developer having been adjusted to a predetermined concentration to be supplied to the developer tank 44 is used. By using a developer having a concentration lower than that of the developer to be concentration-adjusted, the adhered toner can be efficiently removed.

In the case of performing stirring operation with the stirrer 62 for cleaning, a stirring operation condition is changed from that for stirring for the concentration adjustment. In particular, in the case of cleaning by stirring operation without using the cleaning developer, it is necessary to drive at a stirring speed faster than that of stirring for the concentration adjustment.

At the time of the concentration adjustment, an object of the stirring at the time of adjusting concentration is to measure a stirring load, that is, the viscosity of the developer. However, the object of the stirring at the time of cleaning is to remove the developer adhered to the stirrer 62. Therefore, it is preferable to increase the driving speed of the stirrer 62 to increase the pressure of friction of the cleaning developer against the surface of a stirring blade.

In particular, the centrifugal force is applied by increasing rotation speed of the stirring blade to more than that for the concentration adjustment and removal of the adhered toner becomes easy. Further, pressure is applied on a stirring blade also by varying rotation speed during the cleaning and removal of the adhered toner becomes easy. Further, it is also effective to reverse the rotation direction at a predetermined timing.

Further, it is desirable to arrange an ultrasonic transducer 65 in the concentration adjustment tank 51 and to apply ultrasonic vibration via the cleaning developer at the time of cleaning because the toner can be easily removed.

<Amount of Cleaning Developer>

In the case of putting the stirrer 62 in the developer, the amount of the cleaning developer is preferably less than the amount of the liquid developer to be adjusted in concentration. At the time of the concentration adjustment, the liquid amount is set so as to make the liquid surface sufficiently higher than the position of a stirrer (a stirring blade) in the concentration adjustment tank 51 (a liquid amount in a overflowing state) to stabilize a stirring load. However, at the time of cleaning the stirring blade, the liquid amount just enough for the stirring blade to hardly come out from the liquid surface is efficient for the removal of contamination.

In the case of the cleaning by supplying liquid against the stirrer 62, the liquid may be squirted from a fixed nozzle against the stirring stirrer, or it is furthermore preferable to provide plural nozzles or the liquid may be squirted in a shower form.

Since the cleaning developer having been used for cleaning can be also used as the developer to be adjusted in concentration after having been once discharged after cleaning. When carrier liquid is used as the cleaning developer, it is preferable to use it as little as possible, whereby the concentration does not get too low, and it is easy to adjust the concentration to a predetermined concentration.

<Reuse of Cleaning Developer>

In the case of reusing the cleaning developer as the developer to be adjusted in concentration, it may be once discharged into the discharged-developer tank 52. However, it is preferable to reuse it as the developer to be adjusted in concentration, the supply solution or the cleaning developer at a suitable timing, without increasing a waste liquid.

It is desirable that the cleaning developer is once discharged into the discharged-developer tank 52 and is reused at a suitable timing for improving efficiency. Alternatively, the cleaning developer may be kept as the developer to be adjusted in concentration in the concentration adjustment tank 51, and the concentration adjustment may be then continued.

Herein, the recovered developer used as the developer to be adjusted in concentration may be a residual developer on the surface of the image carrier in addition to a residual developer on the developer roller, or may be recovered from any other members on which the liquid developer adheres. However, all these developer have different concentrations. In the case of reusing these developers, they may be used all in one lump, however, it is efficient and preferable to suitably use them as a developer to be adjusted in concentration, the first supplemental developer having a high concentration, and the second supplemental developer having a low concentration, separately.

<Processing of (Recovered) Developer to be Adjusted in Concentration Depending on Concentration>

How high the concentration of the recovered developer may be estimated based on a B/W ratio of images having been printed out or may be calculated based on a stirring load by arranging a stirrer also in the recovered developer tank 53. Of course, it is possible to enter a concentration adjustment operation without estimating the concentration of the recovered developer.

<Cleaning Timing of Stirrer>

The cleaning may be performed before the concentration adjustment tank 51 is left in an empty state, or after the concentration adjustment tank 51 has been left for a certain period dime in an empty state. It is not necessary to perform cleaning as long as the concentration adjustment is continuously repeated.

In particular, the stirrer 62 performs empty stirring operation after the concentration -adjusted developer is discharged from the concentration adjustment tank 51, for example, before the image forming apparatus being turned off or after finishing print operation of one job, or the controller 61 controls pouring the cleaning developer into the concentration adjustment tank 51 at a predetermined timing and put the stirrer 62 in the cleaning developer, or causes the stirrer 62 to operate while the cleaning developer is being supplied. Alternatively, just after the power supply being turned on or when starting the operation of an image forming apparatus, the controller 61 controls so as to supply the cleaning developer into the concentration adjustment tank 51 at a predetermined timing, and causes the stirrer 62 to operate while being put in the cleaning developer.

Further, if it is anticipated that concentration adjustment will not be performed for a certain time in the future, that is, the concentration adjustment tank 51 will be kept empty, the empty stirring operation may be performed, or the cleaning developer is supplied into the concentration adjustment tank 51 to make the stirrer 62 be put in the cleaning developer or be driven while the developer being supplied, whereby the cleaning is performed. A certain period of time may be set depending on characteristics of the developer. Further, after the concentration adjustment has not been performed for a certain period of time, that is, when starting the concentration adjustment after a concentration adjustment tank has been empty, the cleaning developer is supplied in the concentration adjustment tank 51 and the stirrer 62 is driven in the cleaning developer to be cleaned.

As a method for detecting elapse of the set certain time without concentration adjustment, for example, used can be a time count since the last stirring load detection movement has been stopped, a time count since finishing the movement of discharging the liquid developer from the concentration adjustment tank, or a time count since another appropriate operation timing.

Since the concentration adjustment in the image forming apparatus is generally set to be performed as needed during operation, a time may be counted since the operation of the image forming apparatus is stopped.

Description will be made on the case that the cleaning is performed at the timing of finishing the concentration adjustment, for example.

When the concentration adjustment of the developer to be adjusted in concentration stored in the concentration adjustment tank 51 is finished, the developer having been concentration adjusted is discharged, and the concentration adjustment tank 51 will be empty. In particular, in the case of using a highly volatile carrier liquid, a carrier liquid adhered on the surface of the stirrer 62 will be soon evaporated. Thus, the dried toner will remain and the weight of the stirrer 62 will change.

The stirring load depends on the weight of the stirrer. As a result, it becomes difficult to detect accurate toner concentration. Therefore, the above-described cleaning is preferably performed immediately after the concentration adjustment tank 51 became empty.

The operation is similar in the case of finishing print operation of one job.

A POD printing machine and a copying machine such as an MFP, plural number of prints are printed out for one sheet of an original. There is a case to print 500 sheets or 1,000 sheets and these are referred to as one job.

At the time of finishing the print operation of one job, the concentration adjustment operation is not generally expected, and the concentration adjustment tank 51 is made empty.

By performing the above-described cleaning after the concentration adjustment tank 51 has come to be empty, it is possible to decrease the change of the weight of the stirrer 62, whereby more accurate detection of toner concentration is realized.

It is similar at the time of turning off of the power supply of the image forming apparatus.

Even in the case of using a non-volatile carrier liquid, the carrier liquid and toner may be separated after being left for a long time, and the toner adhesion on stirrer 62 may be caused. By performing the above-described cleaning after the concentration adjustment tank 51 has come to be empty, it is possible to decrease the residual liquid developer on the stirrer 62, resulting in more accurate detection of toner concentration.

In the following, there will be described a processing procedure example of determining to conduct the cleaning and then controlling the conduct of cleaning, when the concentration adjustment is finished and the concentration adjustment tank 51 is made empty.

(Processing Example of Method for Concentration Adjustment 1)

Figure 6:
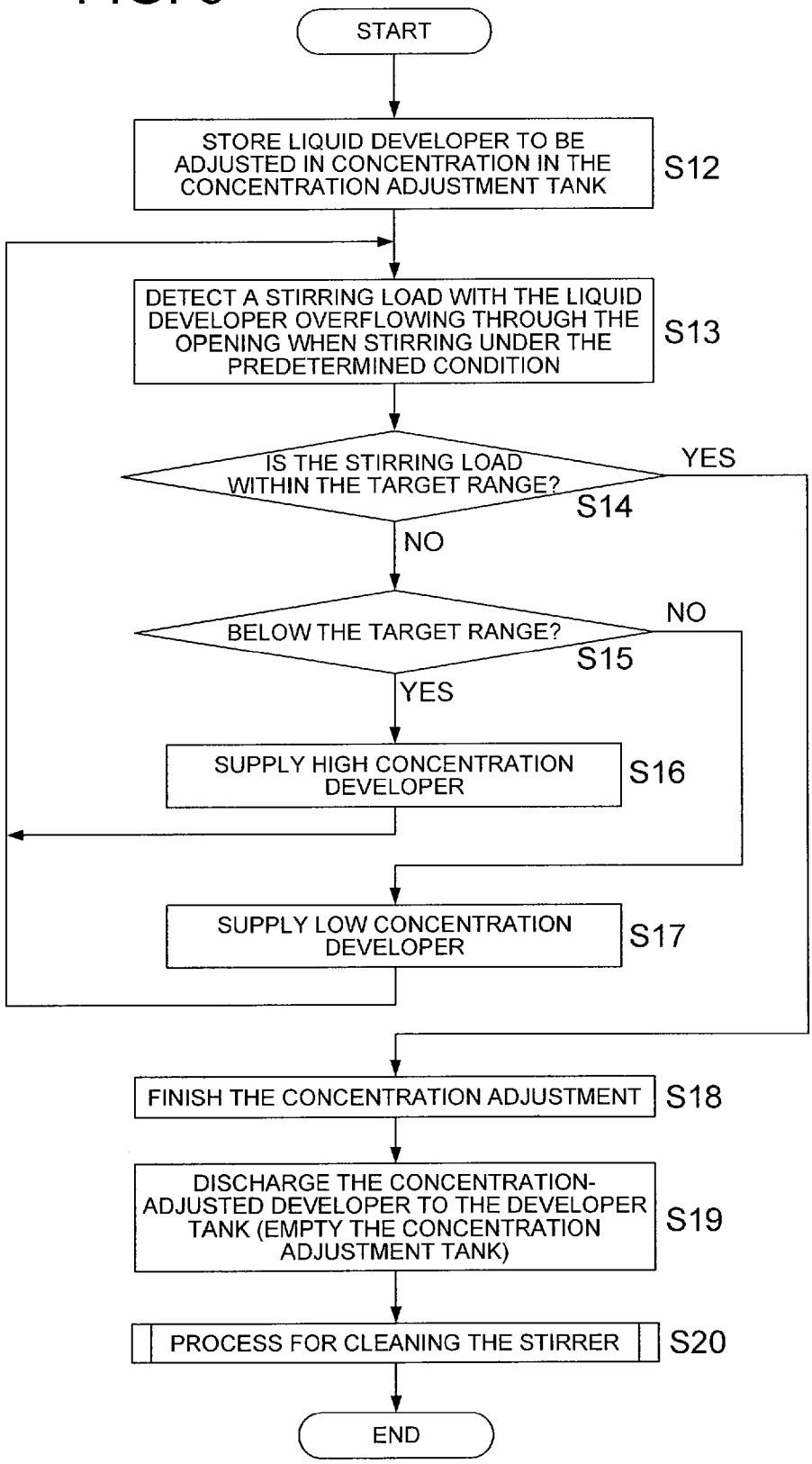
FIG. 6 is a flow chart to show a processing example of a method for adjusting concentration in the developer concentration adjustment apparatus of the embodiment.

FIG. 6 is a flow chart to show a processing example of a method for concentration adjustment of the developer concentration adjustment apparatus. The processing example of the method for concentration adjustment of the developer concentration adjustment apparatus will be explained in reference to FIG. 6.

<Processing Procedure Example of Method for Concentration Adjustment>

The concentration adjustment tank 51 is empty at the beginning of the developer concentration adjustment.

First, in step S12, the developer to be concentration-adjusted such as the recovered developer in the recovered developer tank 53 is stored in the concentration adjustment tank 51 as the developer to be adjusted in concentration. That is to say, step S12 functions as a developer storing process.

Successively, in step S13, the drive section 63 drives the stirrer 62 based on an indication from the controller 61 to start stirring the developer to be adjusted in concentration, at a predetermined rotation number. In addition, the load detector 64 measures the current value as the stirring load. That is to say, step S13 functions as a load detection process.

Steps S14 and the subsequent steps are control processes.

In the next step S14, the measured current value, which has been measured by stirring a developer to be adjusted in concentration, is compared with the target range based on the predetermined target value.

When the measured current value is within the target range (step S14: Yes), go to step S18. That is, the concentration adjustment is finished. When the measured current value is out of the target range (step S14: No), go to step S15.

In step S15, it is judged whether the measured current value, which is out of the target range, is below the target range or not. When it is under the target range (step S15: Yes), step S16 will be conducted. When it is above the target range (step S15: No), step S17 will be conducted.

Step S16 is the first supply process, and the first supplemental developer (a high concentration developer) is supplied because the measured concentration of the developer to be adjusted in concentration is under the target concentration. Thereafter, returning to step S13, and the load detection process is performed again.

Step S17 is the second supply process, and the second supplemental developer (a low concentration developer) is supplied because the measured concentration of the developer to be adjusted in concentration is above the target concentration. Thereafter, returning to step S13, and the load detection process is performed again.

As described above, steps S16 and S17 function as the supply process.

After exiting from the repeated processes from step S14 and finishing adjustment in step S18, the concentration-adjusted developer in the concentration adjustment tank 51 is supplied into the developer tank 44 for use in development, in step S19.

At this time, the concentration adjustment tank 51 is made empty by the control of the controller 61. In step S20, the cleaning process of the stirrer is conducted after the tank 51 gets empty.

<Processing Procedure Example of Cleaning of Stirrer>

Figure 7:
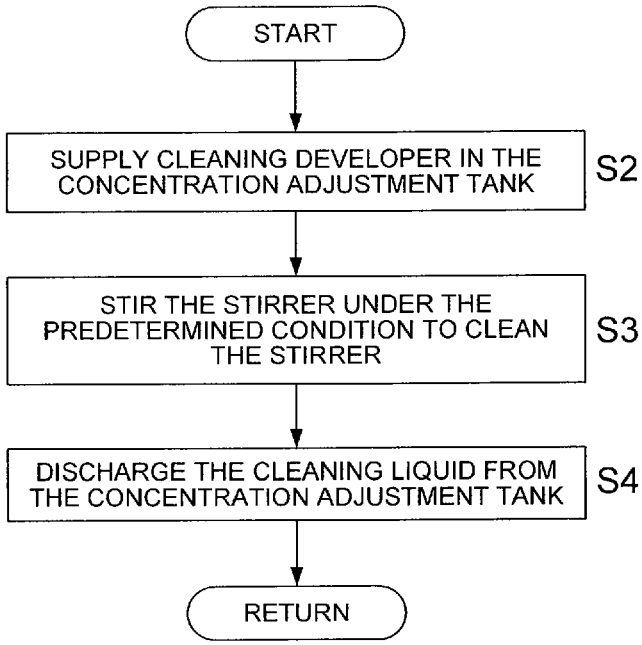
FIG. 7 is a flow chart to show a processing procedure example of a process of cleaning the stirrer described in FIG. 6.

FIG. 7 is a flow chart to show a processing procedure example of a cleaning process (step S20) of the stirrer in FIG. 6. The processing procedure example of the cleaning process of the stirrer will be explained in reference to FIG. 7.

In FIG. 7, first in step S2, in order to clean the stirring member 62, the controller 61 pours a predetermined amount of the cleaning developer into concentration adjustment tank 51 according to a predetermined procedure. The cleaning developer, for example, is the carrier liquid prepared as the second supplemental developer.

In step S3, the controller 61 conducts the stirring of the stirrer 62 which is put in the cleaning developer or being rinsed with the pouring liquid under a predetermined condition, whereby the stirrer 62 is cleaned. The predetermined condition is the speed or the time duration of rotating the stirrer (a stirring blade), and the rotation speed is set to faster than that at the time of the concentration adjustment.

In step S4, the controller 61 discharges the cleaning developer from the concentration adjustment tank 51. This is to make the tank 51 empty to store the developer to be adjusted in concentration in the following concentration adjustment. Naturally, it is desirable to reuse the cleaning developer as it has been already described.

Herein, in the case of performing the cleaning by the empty stirring operation without using the cleaning developer, steps S2 and S4 are omitted, and only the process of step S3 is conducted.

The description on the cleaning process is completed in the above description. Returning to the flow chart to of FIG. 6 showing the processing example of the method for concentration adjustment, the concentration adjustment process is finished.

(Processing Example of Method for Concentration Adjustment 2)

Figure 10:
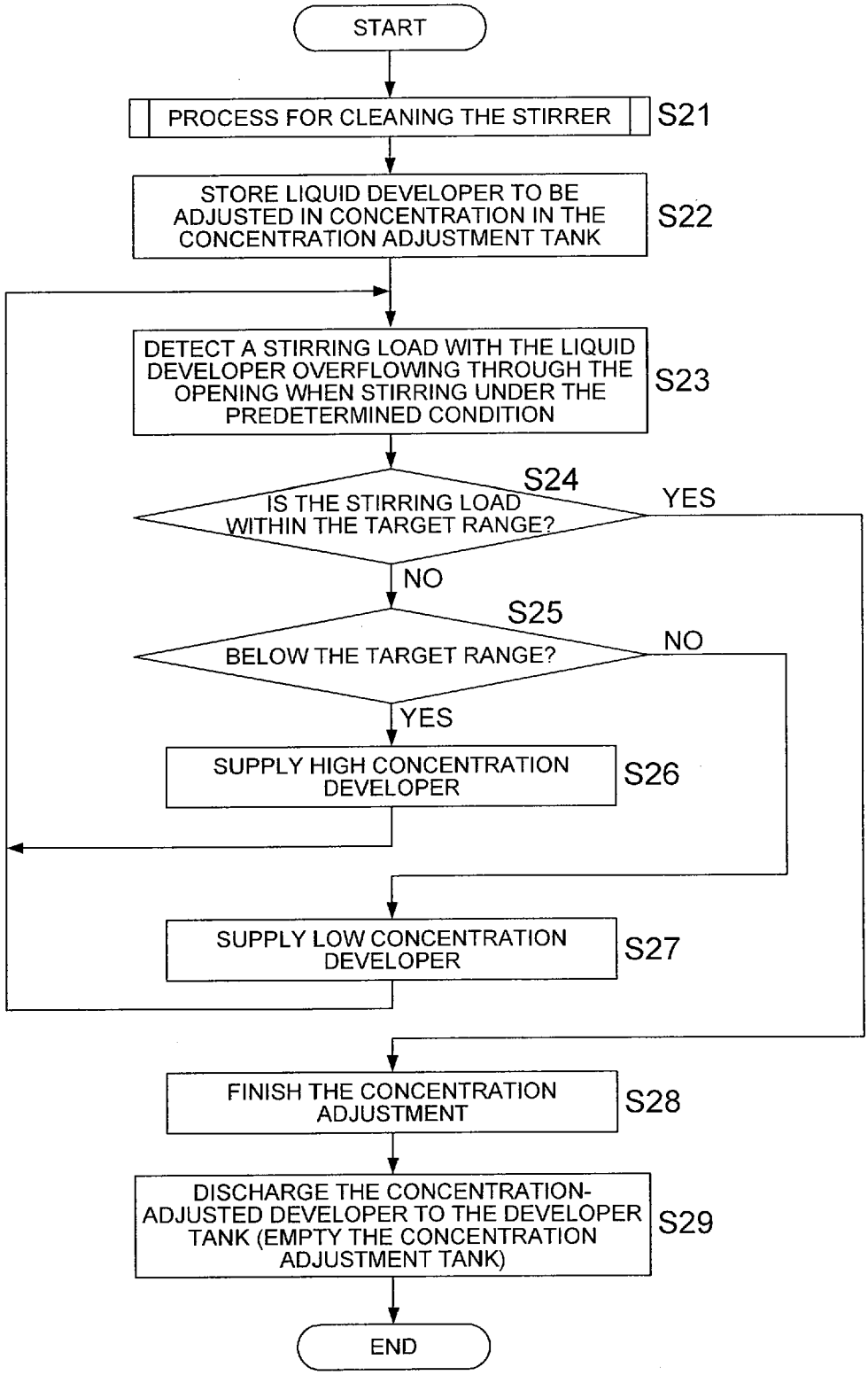
FIG. 10 is a flowchart to show a processing example of a method for adjusting concentration of the developer concentration adjustment apparatus.

FIG. 10 is a flow chart to show a processing example of a method for the concentration adjustment in the developer concentration adjustment apparatus. The processing example of the method for the concentration adjustment in the developer concentration adjustment apparatus will be explained in reference to FIG. 10.

At the start of the developer concentration adjustment, firstly, in step S21, the concentration adjustment tank 51 has no liquid developer in it. The controller 61 judges, according to a predetermined processing procedure, whether the cleaning should be performed or not, and controls the practice of the cleaning.

Figure 11:
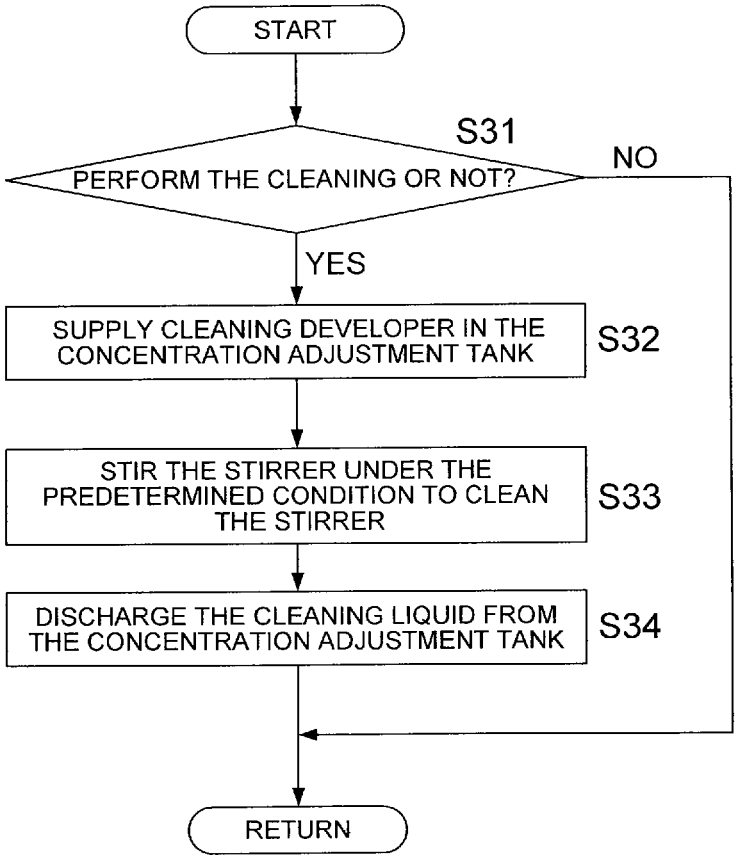
FIG. 11 is a flowchart to show a processing procedure example of a cleaning process of the stirrer described in FIG. 10.

FIG. 11 is a flow chart to show the processing procedure example of the cleaning process (step S21) of the stirrer in FIG. 10. The processing procedure example of the cleaning process of the stirrer will be explained in reference to FIG. 11.

<Processing Procedure Example of Stirrer Cleaning>

In FIG. 11, firstly in step S31, the time is counted since concentration adjustment tank 51 has become empty, and the controller 61 judges whether the cleaning of the stirrer should be performed or not based on a predetermined processing procedure. The judgment is conducted based on whether the result of the time count reaches the predetermined time set in advance.

In the case when it is judged in step S31 (step S31: Yes) that a certain time has elapsed, go to step S32 to start the practice of cleaning. In the case when it is not judged in step S31 (step S31: No) that the certain time has not elapsed, the cleaning is not performed, return to the flow of FIG. 10, and the cleaning process of the stirrer (step S21) is finished.

Next in step S32, the controller 61 supplies a predetermined amount of the cleaning developer into the concentration adjustment tank 51 according to a predetermined processing procedure for the cleaning of the stirrer 62. the cleaning developer is, for example, the carrier liquid prepared as the second supplemental developer.

In step S33, the controller 61 performs the stirring with the stirrer 62 under a predetermined condition to clean the stirrer 62. The predetermined condition is the speed and the time duration of the rotation of the stirrer (a stirring blade), and the rotation speed is set to be faster than the rotation speed at the concentration adjustment.

In step S34, the controller 61 discharges the cleaning developer from the concentration adjustment tank 51. This is to make the tank 51 empty to store the developer to be adjusted in concentration in the successive concentration adjustment. Of course, the cleaning developer may be remained as it is in concentration adjustment tank 51 to be used for successive concentration adjustment, as has been described above.

The description on the cleaning process of the stirrer is completed the above description. Now, return to a flow chart which shows a processing example of a method for concentration adjustment in FIG. 10.

<Processing Procedure Example of Method for Concentration Adjustment>

In FIG. 10, the cleaning process of the stirrer is finished as described above, and going on to step 22 to start the concentration adjustment process.

First, in step S22, the developer to be concentration-adjusted such as the recovered developer in the recovered developer tank 53 is stored in the concentration adjustment tank 51 as the developer to be adjusted in concentration. That is to say, step S22 functions as a developer storing process. Of course, the cleaning developer may be remained in the tank 51. In that case, the developer to be concentration-adjusted is added into the tank 51.

Successively, in step S23, the drive section 63 drives the stirrer 62 based on an indication from the controller 61 to start stirring the developer to be adjusted in concentration, at a predetermined rotation number. In addition, the load detector 64 measures the current value as the stirring load. That is to say, step S23 functions as a load detection process.

Steps S24 and the subsequent steps are control processes.

In the next step S24, the measured current value, which has been measured by stirring a developer to be adjusted in concentration, is compared with the target range based on the predetermined target value.

When the measured current value is within the target range (step S24: Yes), go to step S28. That is, the concentration adjustment is finished. When the measured current value is out of the target range (step S24: No), go to step S25.

In step S25, it is judged whether the measured current value, which is out of the target range, is below the target range or not. When it is below the target range (step S25: Yes), step S26 will be conducted. When it is above the target range (step S25: No), step S27 will be conducted.

Step S26 is the first supply process, and the first supplemental developer (a high concentration developer) is supplied because the measured concentration of the developer to be adjusted in concentration is under the target concentration. Thereafter, returning to step S23, and the load detection process is performed again.

Step S27 is the second supply process, and the second supplemental developer (a low concentration developer) is supplied because the measured concentration of the developer to be adjusted in concentration is above the target concentration. Thereafter, returning to step S23, and the load detection process is performed again.

As described above, steps S26 and S27 function as the supply process.

After exiting from the repeated processes from step S24 and finishing adjustment in step S28, the concentration-adjusted developer in the concentration adjustment tank 51 is supplied into the developer tank 44 for use in development, in step S29.

At this time, the concentration adjustment tank 51 is made empty by the control of the controller 61. The time is counted since the tank 51 gets empty until the next concentration adjustment, to judge the execution of the next cleaning.

The description of the processing procedure of the method for concentration adjustment in the concentration adjustment apparatus is completed above.

According to the developer concentration adjustment apparatus of the embodiment, the method for developer concentration adjustment and the image forming apparatus using the same, to restrain residual adhesion of toner to the stirrer in the concentration adjustment tank when the concentration adjustment tank is made empty at the time of finishing the concentration adjustment, the stirrer is cleaned with the carrier liquid or the liquid developer having a concentration lower than the predetermined concentration or is cleaned by empty rotation without being put in the developer. Alternatively, at the time of the concentration adjustment, the cleaning developer is supplied into the concentration adjustment tank and the stirring operation is performed with the stirrer put in the cleaning developer in the concentration adjustment tank, whereby the stirrer is cleaned. As a result, it is possible to reduce the generation of a trouble of abnormal detection of toner concentration due to dry adhesion of the residual developer on the stirrer and to enable accurate concentration adjustment.

First Example

An experiment was conducted to confirm an advantage, of the cleaning of the stirrer, in the concentration adjustment using the concentration adjustment apparatus of FIG. 3 and the concentration measurement section of FIG. 4. There will be described the result of the evaluation of the effect to the accuracy in the concentration measurement in the cases of presence and absence of the cleaning.

<Apparatus Conditions>

The conditions of the apparatus will be described in the following.

The inner diameter of the concentration adjustment tank was ϕ85 mm. The stirring blade was provided with 6 blades of fans having the diameter of ϕ75 mm and the height of 10 mm at a position of 10 mm from the bottom.

As the opening, an opening having a height of 20 mm and a width of 30 mm was provided at a position of 60 mm from the bottom.

The rotation speed of the stirring blade is set to 250 rpm for the concentration adjustment.

<Developer>

As the liquid developer, the liquid developer containing toner dispersed in a carrier liquid was used.

As the carrier liquid an IP Solvent liquid was used, and polyester toner having an average particle diameter of 1.9 μm was prepared by wet grinding method as toner.

The predetermined concentration of the concentration adjustment was set to a T/C ratio of 25%.

<Experiment Method>

The procedure as the experiment method will be shown in the following.

(1) The concentration adjustment tank was made empty after the concentration adjustment to the predetermined concentration (a T/C ratio of 25%) by use of the above-described concentration adjustment apparatus and developer.

(2) Thereafter, as for examples, the cleaning of the stirring blade was performed with the following different factors. As for a comparative example, cleaning was not performed.

As the cleaning developer, the carrier liquid was used as is.

The cleanings were performed according to the following three cleaning methods (refer to tables 1-3 described later).

Examples 1, 5 and 9: The carrier liquid was squirted a shower form to hit the stirrer.

Examples 2, 6 and 10: The carrier liquid was ejected from a nozzle, which was fixed in position, to hit the stirrer.

Examples 3, 7 and 11: The stirrer was put in the carrier liquid.

Examples 4, 8 and 12: The stirrer was made to conduct an empty stirring operation The carrier liquid has a concentration of 0%. The cleaning time was set to 30 seconds, and a supply amount of liquid was set to 10 ml/s. Each cleaning developer was discharged immediately after the cleaning.

As for the rotation speed of the stirring blade during the cleaning, it was rotated at each of the three following speeds for each of examples 5-7 (refer to table 2). In example 8, the rotation was performed at two speeds of a and b.

a: 350 rpm which is faster than that for the concentration adjustment b: 250 rpm which is same as that for the concentration adjustment c: 150 rpm which is slower than that for the concentration adjustment Herein, as for examples 1-4 and 9-12, the rotation speed is 250 rpm.

As for the material of the stirring blade, each of the following three materials was used for each of examples 9 to 12 (refer to table 3).

a: stirring blade made of SUS, the surface of which is coated with PFA b: stirring blade made of PP resin c: stirring blade made of SUS Herein, in examples 1 to 8, a stirring blade made of SUS was used.

(3) After the concentration adjustment tank was left empty for 20 minutes, the developer the concentration of which was known (T/C ratio of 25%; measured with a density meter) is stored and the stirring load of the stirring blade was measured to determine a toner concentration.

<Evaluation Method>

To evaluate an advantage of cleaning, the concentration measurement result in each examples and comparative examples was evaluated based on a deviation (±%) from the known concentration (25%) which is the target value.

The smaller the evaluation deviation (%) is, the higher the measurement accuracy is, and vice versa.

<Evaluation Result>

The cleaning conditions and the evaluation results of examples 1-4 and comparative example 1 are shown in table 1. Further, the cleaning conditions and the evaluation results of examples 5-8 are shown in table 2, and those of examples 9-12 are shown in table 3.

TABLE 1

| | Cleaning | Cleaning method | Blade material | Rotation speed (rpm) | Evaluation (%) |
|---|---|---|---|---|---|
| Example 1 | yes | Shower supply | SUS | 250 | 0.55 |
| Example 2 | | Fixed supply | SUS | 250 | 0.7 |
| Example 3 | | Put in liquid | SUS | 250 | 0.9 |
| Example 4 | | Empty stirring | SUS | 250 | 0.9 |
| Comparative example 1 | No | — | SUS | 0 | 1.8 |

TABLE 2

| | | Evaluation (%) Rotation speed (rpm) | | |
|---|---|---|---|---|
| | Cleaning method | 350 | 250 | 150 |
| Example 5 | Shower pouring | 0.45 | 0.55 | 0.65 |
| Example 6 | Fixed pouring | 0.55 | 0.7 | 0.85 |
| Example 7 | Put in liquid | 0.8 | 0.9 | 1.05 |
| Example 8 | Empty stirring | 0.7 | 0.9 | — |

TABLE 3

| | Cleaning method | Evaluation (%) Blade material | | |
|---|---|---|---|---|
| | | PFA surface | PP resin | SUS |
| Example 9 | Shower pouring | 0.25 | 0.4 | 0.55 |
| Example 10 | Fixed pouring | 0.3 | 0.5 | 0.7 |
| Example 11 | Immersion | 0.5 | 0.7 | 0.9 |
| Example 12 | Only empty stirring | 0.55 | 0.65 | 0.9 |

Figure 5A:
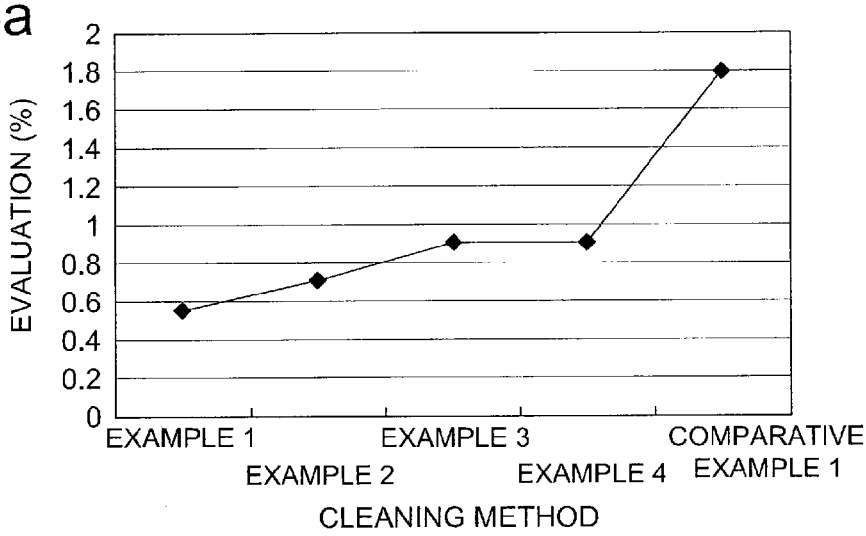
FIGS. 5*a*, 5*b* and 5*c* are graphs to show plotted evaluation results of each example and a comparative example with respect to cleaning conditions.
Figure 5B:
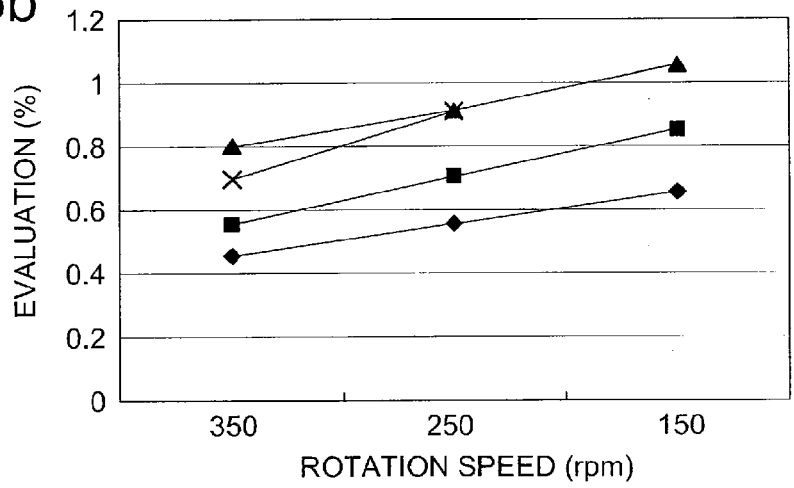
Figure 5C:
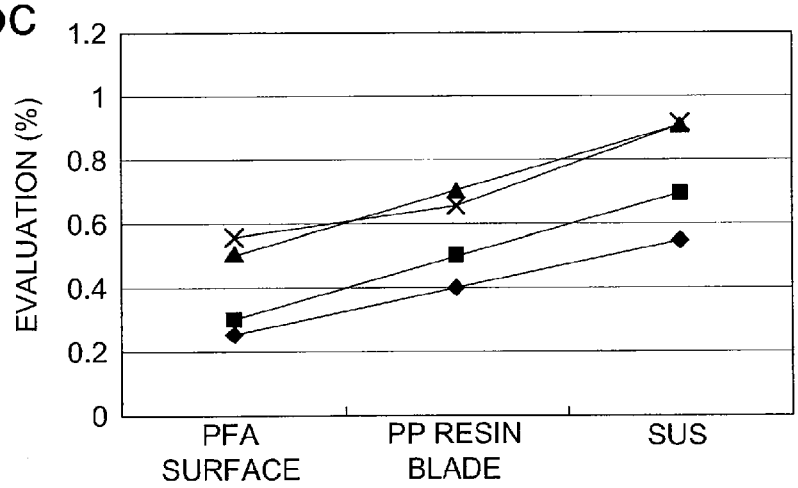

Further, in FIG. 5*a*, shown is a graph, in which the evaluation results of examples 1-4 and comparative example 1 corresponding to table 1 are plotted. In FIG. 5*b*, shown is a graph, in which the evaluation results of examples 5-8 corresponding to table 2, in order from the bottom, and in FIG. 5*c*, shown is a graph, in which the evaluation results of examples 9-12 in table 3. In FIG. 5*c*, the solid diamond denotes example 9, the solid square denotes example 10, the solid triangular denotes example 11, and the cross denotes example 12.

The following is clear as shown in the results of tables 1-3 and FIGS. 5*a*-5*c*.

1. All the evaluation results of examples 1-12, in which the cleaning was performed, show better results than comparative example 1, in which cleaning was not performed.

By performing the cleaning after the concentration adjustment process, the toner adhered to the stirring blade is removed before the concentration adjustment tank gets empty, and the accuracy of the stirring load measurement, that is, the concentration measurement is high. Thereby, concentration adjustment process with high accuracy is possible.

Herein, the cleaning developer having been used was reused afterward as the developer to be adjusted in concentration; however, that reused developer caused no trouble in the concentration adjustment and the operation in the development apparatus.

2. Evaluation of any one of examples 1-4 (maximum of 0.9%) is better than comparative example 1 (1.8%). However, the cases where the developer was squirted from the nozzle to hit the stirring blade have better efficiency of cleaning and better evaluation results than the cases where the stirring blade was cleaned in the cleaning developer and was in the empty-stirring operation. Further, the case of squirting in a shower form is more effective than the case of squirting from the fixed nozzle. It is desirable to perform the cleaning with ejection in a shower form to improve the effect of cleaning.

3. Evaluation of any one of examples 5-8 (maximum of 1.05%) is better than comparative example 1 (1.8%). However, there is a tendency that the higher rotation speed of the stirring blade at the time of cleaning resulted in the better evaluation results, because a greater centrifuge force caused by a higher speed facilitated the removal. To further increase the effect of cleaning, it is desirable to perform cleaning with the stirring blade at a higher speed than when detecting the stirring load for the concentration adjustment. In particular, in the case of cleaning by only empty stirring operation, it is preferable to rotate at a higher speed than when stirring for detecting the stirring load detection for the concentration adjustment.

Herein, it is desirable to vary the rotation speed during cleaning because it changes the pressure applied to the stirring blade, thereby facilitate the removal.

Any one of the evaluations of examples 9-12 (maximum of 0.9%) is better than comparative example (1.8%). However, there is a tendency that toner is hard to adhere and is easy to be removed to show a better evaluation results when at least the surface of the stirring blade is formed of a water-repellant material compared to general material such as SUS. To improve the effect of cleaning, it is preferable to use the stirring blade having been treated with a water-repellant coating containing fluorine material.

As described above, in a developer concentration adjustment apparatus, a method for concentration adjustment, and an image forming apparatus using the same according to this embodiment, when a concentration adjustment tank is made to be an empty state such as at the time of finishing concentration adjustment, a stirrer is cleaned by use of a carrier liquid or a liquid developer having a concentration lower than a predetermined concentration or is cleaned by empty rotation without being immersed in a developer, to restrain remaining adhesion of such as toner on a stirrer in a concentration adjustment tank.

Second Example

An experiment was conducted to confirm an advantage, of the cleaning of the stirrer, in the concentration adjustment using the concentration adjustment apparatus of FIG. 3 and the concentration measurement section of FIG. 4. There will be described the result of the evaluation of the effect to the accuracy in the concentration measurement in the cases of presence and absence of the cleaning.

<Apparatus Conditions>

The conditions of the apparatus will be described in the following.

The inner diameter of the concentration adjustment tank was ϕ85 mm. The stirring blade was provided with 6 blades of fans having the diameter of ϕ75 mm and the height of 10 mm at a position of 10 mm from the bottom.

As the opening, an opening having a height of 20 mm and a width of 30 mm was provided at a position of 80 mm from the bottom.

The rotation speed of the stirring blade is set to 200 rpm for the concentration adjustment.

<Developer>

As the liquid developer, the liquid developer containing toner dispersed in a carrier liquid was used.

As the carrier liquid an IP Solvent liquid was used, and polyester toner having an average particle diameter of 1.9 μm was prepared by wet grinding method as toner.

The predetermined concentration of the concentration adjustment was set to a T/C ratio of 25%.

<Experiment Method>

The procedure of the experiment will be shown below.

(1) By use of the above-described concentration adjustment apparatus and developer, a concentration adjustment tank was kept for 1 week in an empty state after the concentration adjustment to a predetermined concentration (T/C ratio of 25%).

(2) Thereafter, as for examples, the cleaning of the stirring blade was performed for the following different factors. As for the comparative examples, cleaning was not performed.

As the cleaning developer, the following 5 types of cleaning developers were used.

a. 100% of carrier liquid (mass ratio)

b. 70% of carrier liquid and 30% of the recovered developer (mass ratio)

c. 50% of carrier liquid and 50% of the recovered developer (mass ratio)

d. 30% of carrier liquid and 70% of the recovered developer (mass ratio)

e. 100% of the recovered developer (mass ratio)

Experiments were performed in the cases of a concentration of 0% as for a carrier liquid, and a concentration of 20% and a concentration of 28% as for the recovered developer. Each cleaning developer was charged immediately before the cleaning and discharged immediately after the cleaning. The charging amount of the cleaning developer was set to an amount just enough for keeping the stirring blade under the liquid surface. It is an amount of ¼ of that for the concentration adjustment.

As for the rotation speed of the stirring blade, the stirring blade was rotated in three kinds of modes.

a. normal speed rotation (r=200 rpm which is same as that for the concentration adjustment)

b. high speed rotation (2r=400 rpm which is twice as that for the concentration adjustment)

c. varied speed rotation (r=200 rpm, 1.5r, 2r)

Rank 3: The deviation from the target value is not less than 0.8% and less than 1.0%.

Rank 2: The deviation from the target value is not less than 1.0% and less than 3.0%.

Rank 1: The deviation from the target value is not less than 3.0%.

Rank 5 is good in measurement precision and rank 1 is poor. Rank 3 and Rank 4 are acceptable levels.

<Evaluation Results>

In table 4, each cleaning condition and evaluation result of examples 13-33 and of comparative examples 2-3 will be shown.

TABLE 4

| | Cleaning | Concentration of recovered liquid | Mixing ratio of developer to be cleaned Carrier liquid/recovered developer | Total concentration | Rotation speed of stirring fan | Addition of ultrasonic vibration | Ranks of evaluation result |
|---|---|---|---|---|---|---|---|
| Example 13 | Yes | 20% | 100:0 | 0.0% | High speed rotation | No | 5 |
| Example 14 | | | | | Varied speed rotation | | 5 |
| Example 15 | | | | | Normal speed rotation | | 4 |
| Example 16 | | | 70:30 | 6.0% | Varied speed rotation | | 5 |
| Example 17 | | | | | Normal speed rotation | | 4 |
| Example 18 | | | 50:50 | 10.0% | Varied speed rotation | | 4 |
| Example 19 | | | | | Normal speed rotation | | 3 |
| Example 20 | | | 30:70 | 14.0% | Varied speed rotation | | 4 |
| Example 21 | | | | | Normal speed rotation | | 3 |
| Example 22 | | | 0:100 | 20.0% | High speed rotation | | 3 |
| Example 23 | | | | | Varied speed rotation | | 3 |
| Example 24 | | | 100:0 | 0.0% | Normal speed rotation | Yes | 5 |
| Example 25 | | | 0:100 | 20.0% | Normal speed rotation | | 3 |
| Example 26 | | 28% | 70:30 | 8.4% | Varied speed rotation | No | 5 |
| Example 27 | | | | | Normal speed rotation | | 4 |
| Example 28 | | | 50:50 | 14.0% | Varied speed rotation | | 4 |
| Example 29 | | | | | Normal speed rotation | | 3 |
| Example 30 | | | 30:70 | 19.6% | Varied speed rotation | | 3 |
| Example 31 | | | | | Normal speed rotation | | 3 |
| Example 32 | | | 0:100 | 28.0% | High speed rotation | | 3 |
| Example 33 | | | | | Varied speed rotation | | 3 |
| Comparative example 2 | | | | | Normal speed rotation | | 2 |
| Comparative example 3 | No | | — | | — | — | 1 |

Time of stirring blade rotation was made to be for 5 minutes, which was constant.

Figure 9A:
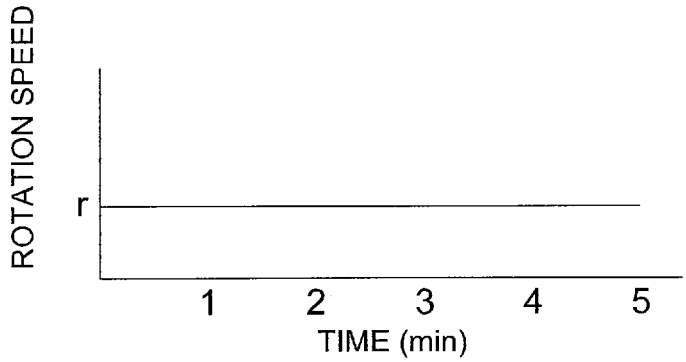
FIG. 9*a* is a graph to show a relationship between time and rotation speed at a normal speed rotation as a stirring condition for cleaning of the stirrer.
Figure 9B:
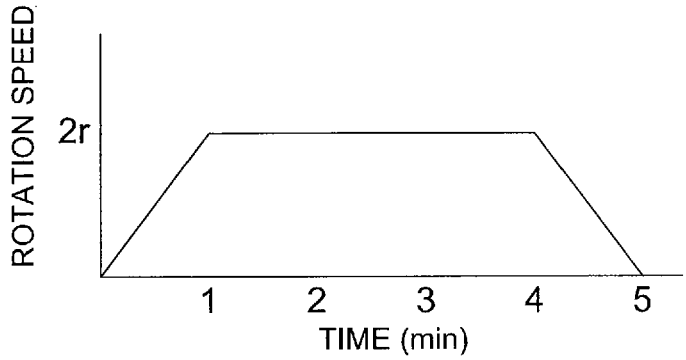
FIG. 9*b* is a graph to show a relationship between time and rotation speed at high speed rotation as a stirring condition for cleaning of the stirrer.
Figure 9C:
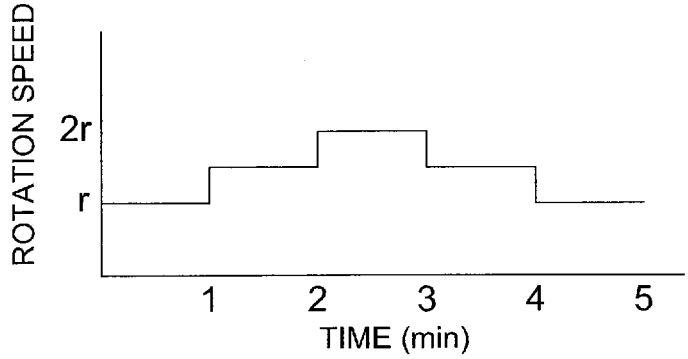
FIG. 9*c* is a graph to show the relationship between time and rotation speed at multiple speed rotation as a stirring condition for cleaning of the stirrer.

In FIGS. 9*a*-9*c* the relationship of time to the rotation speed in each mode will be shown. FIG. 9*a* represents the general rotation, FIG. 9*b* the high speed rotation and FIG. 9*c* the varied speed rotation, respectively.

Further, in some of the examples, an ultrasonic transducer was arranged to provide ultrasonic vibration during the cleaning.

(3) A developer having a known concentration (T/C ratio of 25%) is stored in the concentration adjustment tank and the stirring load of the stirring blade was measured to determine toner concentration. To perform the evaluation of an effect of the cleaning, the concentration measurement result in each of the examples and comparative examples was evaluated according to the following evaluation method.

<Evaluation Method>

The deviation of the measured result (±%) from the known concentration (25%) which is the target value was evaluated based on ranks shown below.

Rank 5: The deviation from the target value is less than 0.6%.

Rank 4: The deviation from the target value is not less than 0.6% and less than 0.8%.

The results in table 4 show the following.

1. All the evaluation results of examples 13-33 in which cleaning was performed by the stirring operation under the stirring conditions different from those for the concentration adjustment show ranks better than the evaluation results of comparative example 2 in which the stirring operation was performed under same conditions as those for the concentration adjustment and of comparative example 3 in which cleaning was not performed. By performing the cleaning before entering the concentration adjustment process, the toner adhered on the stirring blade is removed to stabilize measurement of a rotation load, that is, precision of concentration measurement. Thereby, concentration measurement with stable precision is possible.

Herein, the cleaning developer having been used for the experiments was reused afterward for the concentration adjustment; however, the reused developer caused no troubles in the concentration adjustment and the use in the development apparatus.

2. Any one of examples 13-33 shows rank 3 or the better, and there is a tendency that the lower the concentration of the cleaning developer, the better the efficiency and the ranks were resulted in. To further increase the effect of the cleaning, it is preferable to perform cleaning by use of the cleaning developer having as lower concentration as possible.

As it is clear from the result, the cleaning developer is preferably the carrier liquid or the liquid developer having a concentration lower than a predetermined concentration and lower than that of the liquid developer to be adjusted in concentration. Further, as such a developer, the second supplemental developer having a concentration lower than a predetermined concentration or a mixed developer of the second supplemental developer and the liquid developer to be adjusted in concentration may be used.

3. Any one of examples 13-33 shows rank 3 or better. However, there is a tendency that the faster the rotation speed is, the easier the toner is to be removed due to the larger centrifugal force caused by the faster rotation speed of the stirring blade, resulting in better ranks and improving the effect of the cleaning. It is desirable to perform cleaning by use of the stirring blade at as high rotation speed as possible.

Herein, it is desirable to vary the rotation speed during cleaning because it changes the pressure applied to the stirring blade, thereby facilitate the removal.

4. Ultrasonic vibration is applied at the time of cleaning in examples 24 and 25. There is a tendency of easier removal of toner due to vibration to show better ranks by application of ultrasonic waves. To improve the effect of the cleaning, it is desirable to perform the cleaning by applying ultrasonic vibration if possible.

As described above, according to the developer concentration adjustment apparatus, the method for concentration adjustment, and the image forming apparatus using the same, the cleaning developer is supplied into the concentration adjustment tank, and the stirring operation is conducted with the stirrer put in the cleaning developer in the concentration adjustment tank at the time of the start of the concentration adjustment, whereby the stirrer is cleaned.

Thereby, it is possible to prevent a trouble of an abnormality in toner concentration detection due to drying-adhesion of the residual developer on the stirrer to facilitate the accurate concentration adjustment.

Herein, the above-described embodiments are examples in all aspect and do not limit the present invention. This invention is not shown by the above-described explanation but by the scope of the appended claims, and it is intended that the present invention covers the modifications and variations of this invention provided that they fall within the scope of the appended claims and their equivalents.

What is claimed is:

1. A developer concentration adjustment apparatus for adjusting a toner concentration of liquid developer containing toner and carrier liquid to a predetermined concentration, the apparatus comprising:

a concentration adjustment tank configured to store first liquid developer which is to be adjusted in concentration, and configured to discharge liquid stored therein, the first liquid developer containing toner and carrier liquid;

a stirrer for stirring the first liquid developer stored in the concentration adjustment tank;

a load detector configured to detect a stirring load of the stirrer while the stirrer is stirring the first liquid developer;

a supplement section configured to supply the concentration adjustment tank with first supplemental developer having a concentration higher than the predetermined concentration, and carrier liquid or second supplemental developer containing second supplemental developer having a concentration lower than the predetermined concentration;

a discharge section configured to discharge the first liquid developer from the concentration adjustment tank; and a controller configured to control the supplement section to supply the first supplemental developer, the second supplemental developer, or the carrier liquid so as to adjust a concentration of the first liquid developer to the predetermined concentration based on the stirring load detected by the load detector, wherein in a cleaning operation for the stirrer, the controller controls the discharge section concentration adjustment tank to discharge the concentration-adjusted first liquid developer from the concentration adjustment so as to empty the concentration adjustment tank, and then controls the supplement section to supply the concentration adjustment tank with the carrier liquid or the second supplemental developer, whereby the stirrer is cleaned with the carrier liquid or the second supplemental developer, and residue of toner in the first liquid developer attached to the stirrer is reduced.

2. The developer concentration adjustment apparatus of claim 1, wherein in the cleaning operation for the stirrer, the stirrer is cleaned while the stirrer is stirring in the carrier liquid or the second supplemental developer in the concentration adjustment tank supplied by the supplement section.

3. The developer concentration adjustment apparatus of claim 1, wherein the supplement section includes a squirting section configured to squirt the carrier liquid or the second supplemental developer against the stirrer, and in the cleaning operation for the stirrer, the supplement section squirts the stirrer with the carrier liquid or the second supplemental developer, whereby the stirrer is cleaned by pressure applied to the stirrer by the carrier liquid or the second supplemental developer squirted against the stirrer.

4. The developer concentration adjustment apparatus of claim 2, wherein in the cleaning operation for the stirrer, the stirrer is stirring at a higher stirring speed than when detecting the stirring load.

5. The developer concentration adjustment apparatus of claim 1, wherein the stirrer includes a stirring blade, and at least a surface of the stirring blade is made of water-repellent material.

6. The developer concentration adjustment apparatus of claim 1, wherein the supplement section includes:

a first supplemental developer supplement section configured to supply the first supplemental developer; and a second supplemental developer supplement section configured to supply the second supplemental developer.

7. The developer concentration adjustment apparatus of claim 1, wherein the concentration adjustment tank has a cylindrical shape and has an opening at a predetermined height so that the stored first liquid developer overflows through the opening when a surface of the first liquid developer reaches the predetermined height, and the load detector is configured to detect the stirring load while the first liquid developer in the concentration adjustment tank is overflowing through the opening or after the first liquid developer has overflown.

8. A developer concentration adjustment apparatus for adjusting a toner concentration of liquid developer containing toner and carrier liquid to a predetermined concentration, the apparatus comprising:

a concentration adjustment tank configured to store first liquid developer which is to be adjusted in concentration, and configured to discharge liquid stored therein, the first liquid developer containing toner and carrier liquid;

a stirrer for stirring the first liquid developer stored in the concentration adjustment tank;

a load detector configured to detect a stirring load of the stirrer while the stirrer is stirring the first liquid developer;

a supplement section configured to supply the concentration adjustment tank with supplemental developer for concentration adjustment;

a discharge section configured to discharge the first liquid developer from the concentration adjustment tank; and a controller configured to control the supplement section to supply the supplemental developer so as to adjust a concentration of the first liquid developer to the predetermined concentration based on the stirring load detected by the load detector, wherein the controller controls the stirrer to stir at a stirring speed higher than when detecting the stirring load after the discharge section discharges concentration adjustment tank have discharged the concentration-adjusted first liquid developer from the concentration adjustment tank to be empty the concentration adjustment tank, whereby residue of the first liquid developer attached to the stirrer is removed.

9. A method for adjusting a toner concentration of liquid developer containing toner and carrier liquid to a predetermined concentration, the method comprising the steps of:

storing first liquid developer which is to be adjusted in concentration, in a concentration adjustment tank, the liquid developer containing toner and carrier liquid;

detecting a stirring load of a stirrer while stirring the first liquid developer stored in the concentration adjustment tank with the stirrer;

supplying the concentration adjustment tank with first supplemental developer having a concentration higher than the predetermined concentration, and carrier liquid or second supplemental developer having a concentration lower than the predetermined concentration;

discharging the concentration-adjusted first liquid developer from the concentration adjustment tank;

controlling amount of the first supplemental developer, the second supplemental developer, or the carrier supplied in the step of supplying first supplemental developer and carrier liquid or second supplemental developer, so as to adjust the concentration of the first liquid developer to the predetermined concentration, based on the detected stirring load in the step of detecting stirring load; and supplying the concentration adjustment tank with the carrier liquid or the second supplemental developer after the concentration-adjusted first liquid developer has been discharged from the concentration adjustment to empty the concentration adjustment tank, whereby the stirrer is cleaned with the carrier liquid or the second supplemental developer, and residue of the toner in the first liquid developer attached to the stirrer is removed.

10. A method for adjusting a toner concentration of liquid developer containing toner and carrier liquid to a predetermined concentration, the method comprising the steps of:

storing liquid developer which is to be adjusted in concentration, in a concentration adjustment tank, the liquid developer containing toner and carrier liquid;

detecting a stirring load of a stirrer while stirring the first liquid developer stored in the concentration adjustment tank with the stirrer at a first stirring speed;

supplying the concentration adjustment tank with supplemental developer for concentration adjustment;

discharging the concentration-adjusted first liquid developer from the concentration adjustment tank;

controlling amount of the supplemental developer supplied in the step of supplying supplemental developer, so as to adjust a concentration of the first liquid developer to the predetermined concentration, based on the detected stirring load in the step of detecting a stirring load; and causing the stirrer to stir at a second stirring speed equal to or higher than the first stirring speed after the concentration adjustment tank has been emptied by discharging the concentration -adjusted first liquid developer from the concentration adjustment tank in the step of discharging the first liquid developer, whereby residue of the first liquid developer attached to the stirrer is removed.

11. An image forming apparatus, comprising:

an image carrier configured to carry an electrostatic latent image formed on a surface thereof;

a liquid developing apparatus configured to develop the electrostatic latent image on the surface of the image carrier to form a toner image; and the developer concentration adjustment apparatus of claim 1, wherein the developer concentration adjustment apparatus is configured to supply the first liquid developer whose concentration has been adjusted to the predetermined concentration to the liquid developing apparatus.

12. The image forming apparatus of claim 11, comprising:

a developer recovery section configured to recover developer from the liquid developing apparatus as the first liquid developer and supply the recovered developer to the developer concentration adjustment apparatus, wherein the developer concentration adjustment apparatus adjusts a concentration of the developer recovered from the liquid developing apparatus to the predetermined concentration.

13. A developer concentration adjustment apparatus for adjusting a toner concentration of liquid developer containing toner and carrier liquid to a predetermined concentration, the apparatus comprising:

a concentration adjustment tank configured to store first liquid developer which is to be adjusted in concentration, and configured to discharge liquid stored therein, the first liquid developer containing toner and carrier liquid;

a stirrer for stirring the first liquid developer stored in the concentration adjustment tank;

a load detector configured to detect a stirring load of the stirrer while the stirrer is stirring the first liquid developer under a first stirring condition;

a first supplement section configured to supply the concentration adjustment tank with first supplemental developer for concentration adjustment; and a discharge section configured to discharge the first liquid developer from the concentration adjustment tank;

a controller configured to control the first supplement section to supply the first supplemental developer so as to adjust a concentration of the first liquid developer to the predetermined concentration, based on the stirring load detected by the load detector, wherein in a cleaning operation for the stirrer, the controller controls in such a manner that before the first liquid developer is stored in the empty concentration adjustment tank for the concentration adjustment, the stirrer is cleaned while being immersed in second liquid developer for cleaning and stirring under a second stirring condition different from the first stirring condition.

14. The developer concentration adjustment apparatus of claim 13, wherein the second liquid developer is carrier liquid or liquid developer whose concentration is lower than the predetermined concentration and the concentration of the first liquid developer.

15. The developer concentration adjustment apparatus of claim 14, wherein the first supplemental developer includes:

second supplemental developer having a concentration higher than the predetermined concentration; and third supplemental developer having a concentration lower than the predetermined concentration, and the first supplement section includes:

a second supplement section configured to supply the concentration adjustment tank with the second supplemental developer; and a third supplement section configured to supply the concentration adjustment tank with the third supplemental developer, wherein the second liquid developer used for cleaning is the third supplemental developer or a mixture containing the third supplemental developer and the first liquid developer which is to be adjusted in concentration.

16. The developer concentration adjustment apparatus of claim 13, wherein in the cleaning operation for the stirrer, the stirrer is stirring at a higher stirring speed than when detecting the stirring load.

17. The developer concentration adjustment apparatus of claim 13, wherein in the cleaning operation for the stirrer, the stirrer is stirring while varying a stirring speed.

18. The developer concentration adjustment apparatus of claim 13, comprising:

an ultrasonic transducer provided in the concentration adjustment tank so as to apply ultrasonic vibration to liquid stored therein, wherein the ultrasonic transducer is activated in the cleaning operation for the stirrer.

19. The developer concentration adjustment apparatus of claim 13, wherein the controller is configured to measure time since the concentration adjustment tank has been emptied with the first liquid developer having been discharged, and configured to determine based on the measured time whether to perform the cleaning operation for the stirrer or not.

20. A method for adjusting a toner concentration of liquid developer containing toner and carrier liquid to a predetermined concentration, the method comprising the steps of:

storing first liquid developer which is to be adjusted in concentration, in a concentration adjustment tank, the liquid developer containing toner and carrier liquid;

detecting a stirring load of a stirrer while stirring the first liquid developer stored in the concentration adjustment tank with the stirrer under a first stirring condition;

supplying the concentration adjustment tank with a first supplemental developer for concentration adjustment;

discharging the concentration-adjusted first liquid developer from the concentration adjustment tank;

controlling amount of the first supplemental developer to be supplied in the step of supplying a first supplemental developer so as to adjust a concentration of the first liquid developer to the predetermined concentration, based on the detected stirring load in the step of detecting a stirring load; and causing the stirrer to stir under a second stirring condition different from the first stirring condition after the concentration adjustment tank has been emptied with the concentration -adjusted first liquid developer having been discharged in the step of discharging the concentration-adjusted first liquid developer, whereby toner attached to the stirrer is removed.

21. An image forming apparatus, comprising:

an image carrier configured to carry an electrostatic latent image formed on a surface thereof;

a liquid developing apparatus configured to develop the electrostatic latent image on the surface of the image carrier to form a toner image; and the developer concentration adjustment apparatus of claim 13, wherein the developer concentration adjustment apparatus is configured to supply the first liquid developer whose concentration has been adjusted to the predetermined concentration to the liquid developing apparatus.

22. The image forming apparatus of claim 21, wherein the controller of the developer concentration adjustment apparatus controls in such a manner that the cleaning operation for the stirrer is performed when the image forming apparatus has been turned on or when operation of the image forming apparatus is started.

* * * * *